US007555235B2

(12) United States Patent
Okabe et al.

(10) Patent No.: US 7,555,235 B2
(45) Date of Patent: Jun. 30, 2009

(54) IMAGE FORMING APPARATUS ENABLING USER TO DIRECTLY CLEAN DISCHARGE WIRE

(75) Inventors: Yasushi Okabe, Nagoya (JP); Naoya Kamimura, Nagoya (JP); Tomitake Aratachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 435 days.

(21) Appl. No.: 11/501,686

(22) Filed: Aug. 10, 2006

(65) Prior Publication Data

US 2007/0036577 A1 Feb. 15, 2007

(30) Foreign Application Priority Data

Aug. 10, 2005 (JP) ..... 2005-232159
Dec. 27, 2005 (JP) ..... 2005-375585

(51) Int. Cl.
*G03G 21/20* (2006.01)
*G03G 15/02* (2006.01)
*G03G 21/18* (2006.01)

(52) U.S. Cl. ..... 399/92; 399/100; 399/115; 399/172

(58) Field of Classification Search ..... 399/92, 399/100, 110, 115, 119, 172
See application file for complete search history.

(56) References Cited

U.S. PATENT DOCUMENTS

| | | | | |
|---|---|---|---|---|
| 4,566,777 | A * | 1/1986 | Honda et al. | 399/100 |
| 4,922,303 | A * | 5/1990 | Takeda et al. | 399/92 |
| 5,697,019 | A * | 12/1997 | Kim | 399/100 |
| 5,940,656 | A * | 8/1999 | Hensel | 399/100 |
| 6,128,458 | A | 10/2000 | Sato | |
| 6,141,519 | A | 10/2000 | Sato | |
| 6,944,413 | B2 * | 9/2005 | Maeda | 399/92 |
| 2003/0053819 | A1 * | 3/2003 | Nomura et al. | 399/110 |

FOREIGN PATENT DOCUMENTS

| | | |
|---|---|---|
| JP | 8-166697 | 6/1996 |
| JP | 9-106146 | 7/1997 |
| JP | 10-198128 | 7/1998 |
| JP | 11-212294 | 8/1999 |
| JP | 11-327301 | 11/1999 |

* cited by examiner

*Primary Examiner*—Sandra L Brase
(74) *Attorney, Agent, or Firm*—Banner & Witcoff, Ltd.

(57) ABSTRACT

A charger includes a frame and a cover member, together defining an internal space. A discharge wire for producing a discharge for a photosensitive drum is disposed within the internal space. A cleaner for cleaning the discharge wire is also disposed within the internal space. When the cover member is open, a user accesses the cleaner and slides the cleaner on the discharge wire, thereby cleaning the discharge wire.

23 Claims, 17 Drawing Sheets

IMAGE FORMING APPARATUS ENABLING USER TO DIRECTLY CLEAN DISCHARGE WIRE

CROSS REFERENCE TO RELATED APPLICATIONS

This application claims priority from Japanese Patent Application Nos. 2005-232159 and 2005-375585 filed Aug. 10, 2005 and Dec. 27, 2005, respectively. The entire content of each of these priority applications is incorporated herein by reference.

TECHNICAL FIELD

The disclosure relates to an electrophotographic image-forming apparatus, such as a laser printer, a photocopier, or a facsimile device. The invention also relates to an image-carrying unit and a developing unit provided in the image-forming apparatus.

BACKGROUND

In chargers provided in laser printers, discharge irregularities may occur when foreign matter becomes deposited on a discharge wire of the charger. Such discharge irregularities are one factor leading to a decline in print quality, causing such printing non-uniformities as unintended color shades. Further, if the foreign matter builds up on the discharge wire, the corona discharge may switch to an arc discharge in some cases. This arc discharge can break up the foreign matter on the discharge wire, scattering foreign matter onto a photosensitive drum and resulting in an even greater decline in image quality if the foreign matter becomes deposited on the surface of the photosensitive drum. For this reason, conventional laser printers are commonly provided with a fan or the like on the rear side of the discharge wire. The fan is used to blow air over the discharge wire in order to prevent foreign matter from depositing thereon (see Japanese unexamined patent application publications Nos. HEI-8166697 and HEI-10-198128).

However, since color printers require a plurality of image-forming units, each including a photosensitive drum, a discharge wire, and the like, there are more restrictions on where fans and the like can be positioned, whereas monochromatic printers to which the prior art described above is applied have less restrictions on the positioning of such components. Therefore, the prior art described above cannot be applied in its current form to a color printer.

Further, while blowing air on a discharge wire can reduce the amount of foreign matter deposited on the wire, this technique does not completely prevent the deposition of foreign matter.

SUMMARY

In view of the foregoing, it is an object of the invention to provide an image-forming apparatus, an image-carrying member unit, and a developing unit capable of alleviating the deposition of foreign matter on a discharge wire, while enabling a user to directly clean the discharge wire as necessary.

In order to attain the above and other objects, the invention provides an image-forming apparatus including an image-carrying member and a charger. The image-carrying member has a surface on which an electrostatic latent image is formed and an axis extending in a predetermined direction. The charger includes a discharge wire that is stretched in the predetermined direction and that produces a discharge toward the surface of the image-carrying member, a frame that is open on a side facing the image-carrying member and that extends in the predetermined direction, a partitioning wall partitioning an internal space of the frame into a discharge space and a ventilating space above the image-carrying member and the discharge space, and a cover that is movable between a closed position and an open position. The partitioning wall is formed with a ventilating hole extending along the predetermined direction and provides communication between the discharge space and the ventilating space. The discharge wire is disposed within the discharge space. The cover in the closed position closing over the ventilating space, and the cover in the open position exposes the ventilating hole to an external space above the ventilating space.

There is also provided an image-carrying unit that is detachably mountable on a main body of an image-forming apparatus by moving toward a mounting position within the main body. The image carrying unit includes an image-carrying member and a charger. The image-carrying member has a surface on which an electrostatic latent image is formed and an axis extending in a predetermined direction. The charger includes a discharge wire that is stretched in the predetermined direction and that produces a discharge toward the surface of the image-carrying member, a frame that is open on a side facing the image-carrying member and that extends in the predetermined direction, a partitioning wall partitioning an internal space of the frame into a discharge space and a ventilating space above the image-carrying member and the discharge space, and a cover that is movable between a closed position and an open position. The partitioning wall is formed with a ventilating hole extending along the predetermined direction and provides communication between the discharge space and the ventilating space. The discharge wire is disposed within the discharge space. The cover in the closed position closing over the ventilating space, and the cover in the open position exposes the ventilating hole to an external space above the ventilating space.

There is further provided a developing unit that is mountable in and removed from an accommodating space within a casing of an image-forming apparatus. The image-forming apparatus includes an image-carrying member having a surface on which an electrostatic latent image is formed, a frame defining a discharge space and a ventilating space, a discharge wire that produces a discharge toward the surface of the image-carrying member and that is disposed within the discharge space, and a cover that is opened and closed over the ventilating space. The developing unit includes a developing member that supplies a developer to the image-carrying member to develop the electrostatic latent image on the surface of the image-carrying member into a visible image, and a pressing member that presses and closes the cover of the image-forming apparatus when the developing unit is moved toward the accommodating space so as to be mounted in the accommodating space.

There is further provided a developing unit that is mountable in and removed from an accommodating space within a casing of an image-forming apparatus. The image-forming apparatus includes a first image-carrying member having a surface on which an electrostatic latent image is formed, a second image-carrying member having a surface on which an electrostatic latent image is formed, a frame defining a discharge space and a ventilating space, a discharge wire that produces a discharge toward the surface of the first image-carrying member and that is disposed within the discharge space, and a cover that is opened and closed over the ventilating space. The developing unit includes a developing member that supplies a developer to the second image-carrying member to develop the electrostatic latent image on the surface of the second image-carrying member into a visible image, and a pressing member that presses and closes the cover of the image-forming apparatus when the developing unit is moved toward the accommodating space so as to be mounted in the accommodating space.

BRIEF DESCRIPTION OF THE DRAWINGS

Illustrative aspects in accordance with the invention will be described in detail with reference to the following figures wherein:

FIG. 7(*b*) is an enlarged side cross-sectional view of the photosensitive drum and the charger with the cover member being completely closed;

FIG. 8(*b*) is an enlarged side cross-sectional view of the photosensitive drum and the Scorotron charger in FIG. 8(*a*), illustrating the mounting of the neighboring developing unit in a mounting space;

FIG. 9(*b*) is an enlarged side cross-sectional view of the photosensitive drum and the Scorotron charger in FIG. 9(*a*), illustrating the mounting of the neighboring developing unit in the mounting space;

FIG. 10(*b*) is an enlarged side cross-sectional view of the photosensitive drum and the Scorotron charger in FIG. 10(*a*), illustrating the mounting of the neighboring developing unit in the mounting space;

FIG. 11(*b*) is an enlarged side cross-sectional view of the photosensitive drum and the Scorotron charger in FIG. 11(*b*) when the cover member is completely closed;

DETAILED DESCRIPTION

Figure 1:
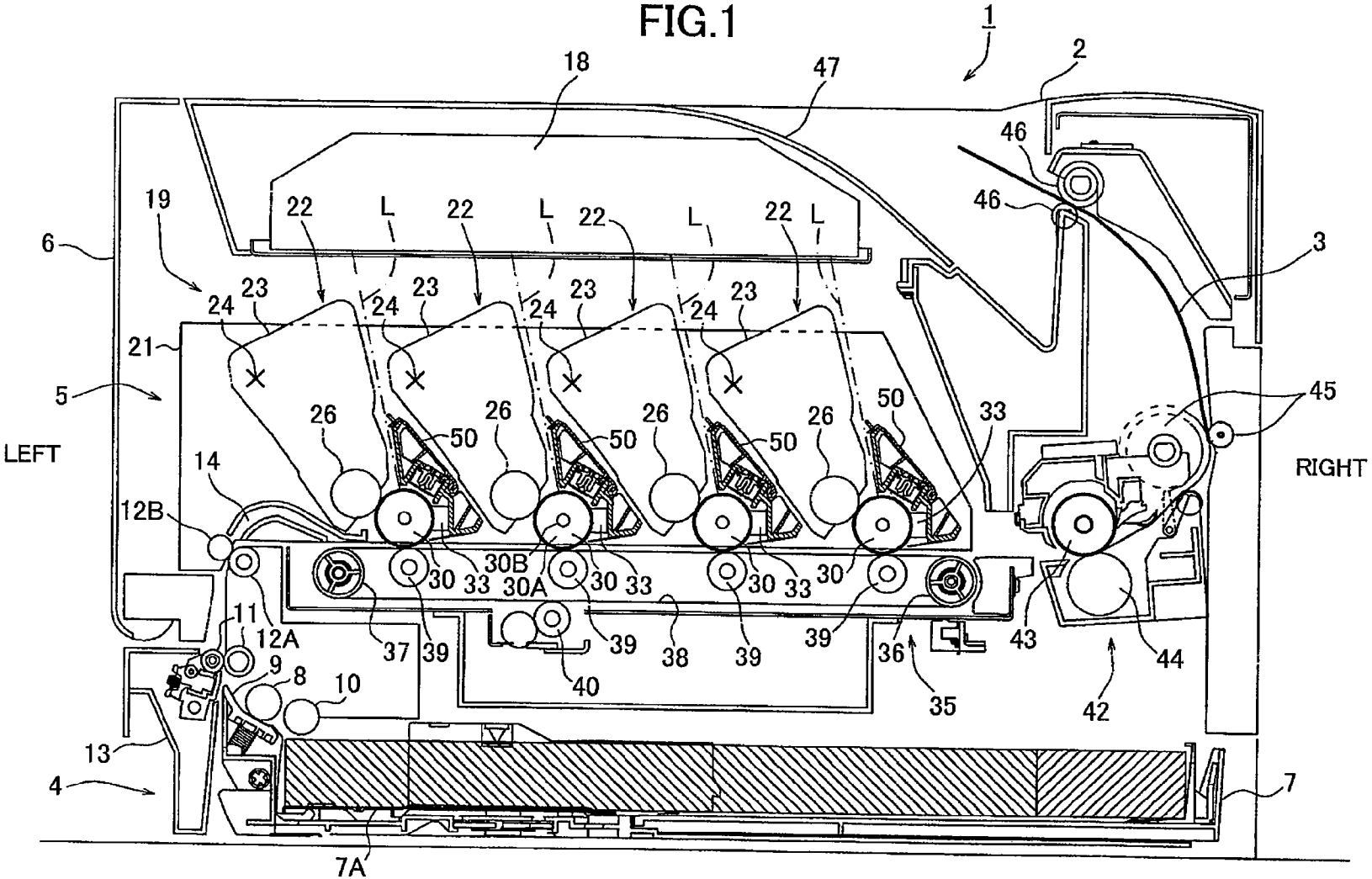
FIG. 1 is a side cross-sectional view showing the general structure of a laser printer serving as the image-forming apparatus of first illustrative aspects of the invention.

Image-forming apparatuses according to some aspects of the invention will be described while referring to the accompanying drawings wherein like parts and components are designated by the same reference numerals to avoid duplicating description.

Figure 2:
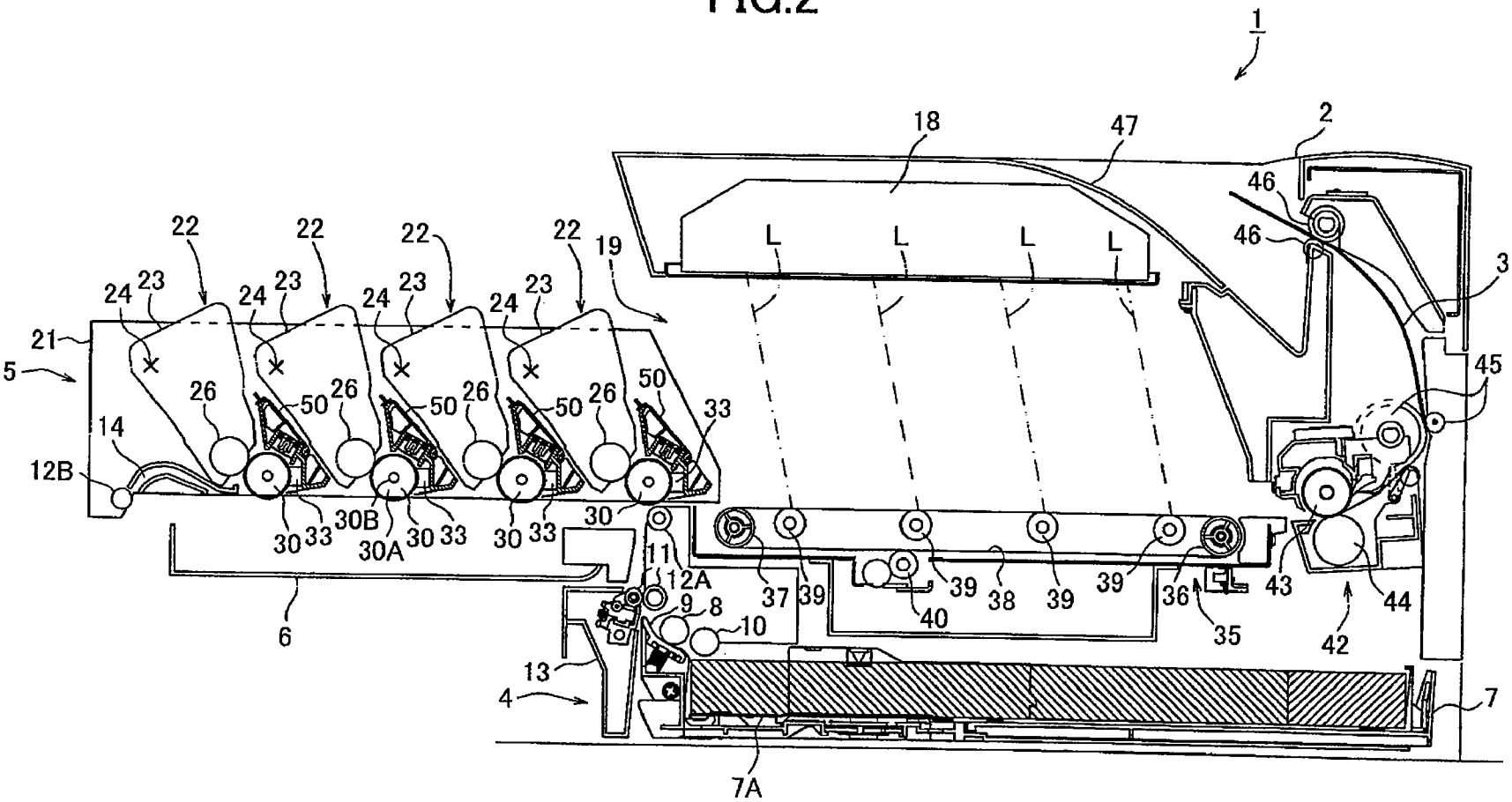
FIG. 2 is a side cross-sectional view of the laser printer when an image-forming unit has been removed from the laser printer.

First, a laser printer 1 serving as the image-forming apparatus according to first illustrative aspects will be described with reference to FIGS. 1 to 7(*b*). FIG. 1 is a side cross-sectional view showing the general structure of the laser printer 1, and FIG. 2 is a side cross-sectional view illustrating an operation for removing an image-forming unit 5 from the laser printer 1.

As shown in FIG. 1, the laser printer 1 is a direct tandem type color laser printer having four photosensitive drums 30 corresponding to the colors black, cyan, magenta, and yellow. The laser printer 1 includes a main casing 2 and, within the main casing 2, a feeding unit 4 for feeding sheets of a paper 3, the image-forming unit 5 for forming images on the paper 3 supplied from the feeding unit 4, and a paper-conveying unit 35 for conveying the paper 3 opposite the image-forming unit 5. In the following description, left and right sides and directions will conform to the left and right sides and directions in FIG. 1.

A front cover 6 capable of opening and closing over the main casing 2 is provided on the left side of the main casing 2. In a closed position shown in FIG. 1, the front cover 6 covers the left surface of the main casing 2 in a substantially vertical orientation. From the closed position, the front cover 6 can be rotated to an open position in a substantially horizontal orientation by moving the top end of the front cover 6 downward toward the left side about the lower end of the front cover 6. When the front cover 6 is in the open position, a drum unit 21 (the image-forming unit 5) described later can be pulled out of the main casing 2 toward the left as shown in FIG. 2. When the front cover 6 is in the closed position, the top edge of the front cover 6 is nearly flush with the top edge of the main casing 2, as shown in FIG. 1.

The feeding unit 4 includes a paper tray 7 that is detachably mounted in a lower section of the main casing 2, a feeding roller 8 and a separating pad 9 disposed above a left end of the paper tray 7, a pickup roller 10 disposed on the right of the feeding roller 8, a pair of paper dust rollers 11 disposed above and to the left of the feeding roller 8, and a pair of registration rollers 12A and 12B disposed above the paper dust roller 11.

The paper tray 7 is formed in a box shape having an open top for loading sheets of paper 3 and a depth capable of accommodating a fixed number of sheets of paper 3 in a stacked state. A left wall 13 is provided on the left end of the paper tray 7 and on the left surface of the main casing 2 below the front cover 6. By pulling the left wall 13 leftward, it is possible to remove the paper tray 7 from the left side of the main casing 2 in a horizontal motion. A paper pressing plate 7A is provided in the bottom surface of the paper tray 7 for supporting the paper 3 in a stacked state. The paper pressing plate 7A is rotatably supported on the right end thereof, while the left end is urged upward by a spring (not shown). With this configuration, the left edge of the paper 3 stacked in the paper tray 7 is constantly urged upward.

The urging force of the paper pressing plate 7A presses the topmost sheet of paper 3 in the paper tray 7 toward the pickup roller 10. During a printing operation, the pickup roller 10 rotates to begin conveying the topmost sheet toward a position between the feeding roller 8 and the separating pad 9. As the sheet of paper 3 becomes interposed between the feeding roller 8 and the separating pad 9, the rotating feeding roller 8 separates and conveys the paper 3 one sheet at a time. The paper dust rollers 11 receive and convey the sheet of paper 3 toward the registration rollers 12A and 12B while removing paper dust from the sheet.

The registration rollers 12A and 12B are a drive roller and a follow roller, respectively. After adjusting the registration of the paper 3, the registration rollers 12A and 12B convey the paper 3 along a paper-conveying path 14 and onto a conveying belt 38 in the paper-conveying unit 35 described later. The paper-conveying path 14 is an arc-shaped path formed in the drum unit 21.

A scanning unit 18 is disposed in the topmost section of the main casing 2. The scanning unit 18 irradiates four laser beams L based on prescribed image data for each color over surfaces of the corresponding photosensitive drums 30 described later in a high-speed scan. The scanning unit 18 emits the four laser beams L diagonally downward and to the right through the bottom surface of the scanning unit 18. The laser beams L form parallel optical paths spaced at prescribed intervals in the left-to-right direction.

An accommodating section 19 is formed inside the main casing 2 below the scanning unit 18 for accommodating the image-forming unit 5 so that the image-forming unit 5 can be mounted in and removed from the accommodating section 19 through the left side of the main casing 2. The image-forming unit 5 includes the drum unit 21, mentioned above, that retains the photosensitive drums 30, Scorotron chargers 50, developing units 22, and cleaning brushes 33 provided for each color.

The four developing units 22 are detachably mounted in the drum unit 21 and correspond to the colors black, cyan, magenta, and yellow, respectively. Each developing unit 22 includes a case 23 having a box shape open on the bottom side, and is formed with a toner-accommodating chamber 24 in the upper section of the case 23 that is filled with the corresponding color of toner. An agitator (not shown) is disposed inside the toner-accommodating chamber 24. When the driving force of a motor (not shown) is inputted, the agitator rotates and stirs toner inside the toner-accommodating chamber 24. A developing roller 26 is disposed on the lower side of the toner-accommodating chamber 24.

The developing roller 26 is rotatably supported in the case 23 of the developing unit 22 and is positioned in contact with the corresponding photosensitive drum 30 when the developing unit 22 is mounted in the drum unit 21. The developing roller 26 includes a metal roller shaft that is covered with a roller member formed of an electrically conductive urethane rubber or silicon rubber containing fine carbon particles or the like. The surface of the roller member is also coated with a urethane rubber or silicon rubber containing fluorine. During a developing operation, a developing bias is applied to the developing roller 26. Further, a motor (not shown) inputs a driving force for rotating the developing roller 26.

Toner discharged from the toner-accommodating chamber 24 is supplied to the developing roller 26 by a supply roller (not shown) provided in the toner accommodating chamber 24. At this time, the toner is positively turbocharged between the supply roller and the developing roller 26. A thickness-regulating blade (not shown) disposed in the toner-accommodating chamber 24 regulates the toner supplied on the developing roller 26 to maintain a thin layer of uniform thickness on the surface of the developing roller 26.

The photosensitive drum 30 is formed in a cylindrical shape and includes a main roller body 30A and a metal roller shaft 30B. The outermost surface of the main roller body 30A is formed of a positive charging photosensitive layer such as polycarbonate. The metal roller shaft 30B extends in the longitudinal direction of the main roller body 30A through the axial center thereof. By rotatably supporting the metal roller shaft 30B in the drum unit 21, the photosensitive drum 30 can rotate with the metal roller shaft 30B. Further, a motor (not shown) inputs a driving force for rotating the photosensitive drum 30.

Each charger 50 includes a charging wire 52 and is disposed in opposition to the corresponding photosensitive drum 30 at a prescribed distance so as not to contact the photosensitive drum 30 and so the charging wire 52 is positioned diagonally above and rightward of the photosensitive drum 30. The charging wire 52 generates a corona discharge for charging the surface of the photosensitive drum 30 with a uniform positive polarity.

Each cleaning brush 33 opposes and contacts the corresponding photosensitive drum 30 on the right side thereof.

The paper-conveying unit 35 is disposed below the image-forming unit 5 when the image-forming unit 5 is mounted in the accommodating section 19. The paper-conveying unit 35 includes a pair of belt support rollers 36 and 37 disposed on a right side and left side, respectively, and arranged parallel to each other, and a conveying belt 38 looped around the belt support rollers 36 and 37. When the belt support roller 36 on the right side is driven to rotate by the driving force of a motor (not shown), the conveying belt 38 moves in a circuit around the belt support rollers 36 and 37. Four transfer rollers 39 are disposed inside the conveying belt 38 at fixed intervals in the left-to-right direction. At these positions, the transfer rollers 39 oppose the respective photosensitive drums 30 with the conveying belt 38 interposed therebetween. A cleaning roller 40 is also disposed on the bottom of the conveying belt 38 for cleaning residual toner from the surface of the conveying belt 38. A sheet of paper 3 conveyed from the registration rollers 12A and 12B along the paper-conveying path 14 contacts the top surface of the conveying belt 38 near the left edge thereof. At this time, the conveying belt 38 moving circuitously electrostatically attracts the sheet to the surface thereof and conveys the sheet rightward.

As the photosensitive drum 30 rotates, the charger 50 charges the surface of the photosensitive drum 30 with a uniform positive polarity. Subsequently, the scanning unit 18 irradiates the laser beam L in a high speed scan over the surface of the photosensitive drum 30 to form an electrostatic latent image on the photosensitive drum 30 corresponding to an image that is to be formed on the paper 3.

Next, the positively charged toner carried on the surface of the developing roller 26 comes into contact with the photosensitive drum 30 as the developing roller 26 rotates. At this time, the toner is supplied to the electrostatic latent image formed on the surface of the photosensitive drum 30, that is, the regions on the surface of the positively charged photosensitive drum 30 that were exposed to the laser beam L and, therefore, have a lower potential. The toner supplied to the photosensitive drum 30 develops the electrostatic latent image into a visible image according to a reverse development process so that a toner image is carried on the surface of the photosensitive drum 30.

As a sheet of paper 3 conveyed on the conveying belt 38 passes through transfer positions between each of the photosensitive drums 30 and the corresponding transfer roller 39, the toner image carried on the surface of the photosensitive drum 30 is transferred onto the paper 3 by a transfer bias applied to the transfer roller 39. After the toner image is transferred onto the paper 3; the paper 3 is conveyed to a fixing unit 42.

The fixing unit 42 is disposed in the main casing 2 to the right of the paper-conveying unit 35. The fixing unit 42 includes a heating roller 43 and a pressure roller 44 disposed in confrontation with each other for fixing the toner image transferred onto the paper 3 to the surface of the paper 3 with heat. After the toner image has been fixed to the paper 3, conveying rollers 45 disposed diagonally above and rightward of the fixing unit 42 convey the paper 3 toward discharge rollers 46 disposed in the top section of the main casing 2. A discharge tray 47 that is substantially level on the left side and slopes downward toward the right side is provided on the top surface of the main casing 2. After the image-forming process described above is completed for each sheet of paper 3, the discharge rollers 46 discharge the paper 3 onto the discharge tray 47 where the sheets accumulate in a stack.

Next, the structure of the charger 50 will be described in detail.

As shown in FIG. 1, the charger 50 is positioned in a narrow gap between neighboring developing units 22. That is, each developing unit 22 has a substantially tapered shape toward the bottom end at which the developing roller 26 is provided in a cross-section taken along a plane orthogonal to the axis of the photosensitive drum 30, and the photosensitive drums 30 are arranged parallel to each other at fixed intervals along the paper conveying direction. The developing units 22 are disposed so that the developing rollers 26 contact the respective photosensitive drums 30 in an upper left portion thereof. This construction produces a narrow gap between neighboring developing units 22, and the charger 50 is positioned in the narrow gap.

Figure 3:
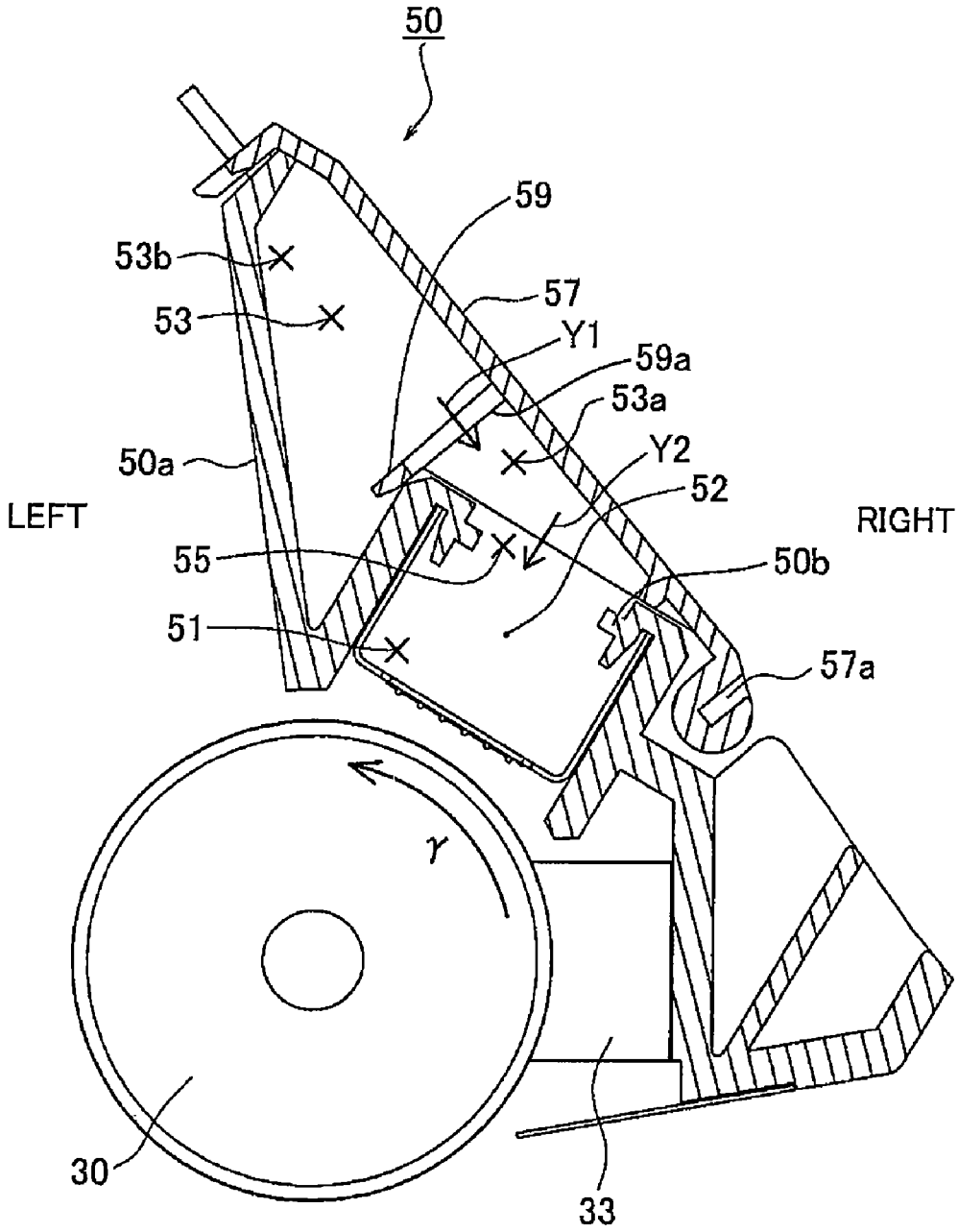
FIG. 3 is an enlarged side cross-sectional view of a photosensitive drum and a Scorotron charger when a wire cleaner has been omitted.

FIG. 3 is an enlarged side cross-sectional view showing the photosensitive drum 30 and the charger 50. However, a wire cleaner 63 has been omitted from FIG. 3. Since the charger 50 is disposed in the narrow gap described above, the charger 50 has a tapered shape in a cross-section taken along a plane orthogonal to the axis of the photosensitive drum 30 that grows gradually narrower toward the top. The charger 50 extends along the axis of the photosensitive drum 30, and has a frame 50*a*, a cover member 57*a*, and the discharge wire 52 that is stretched in a direction along the axis of the photosensitive drum 30.

The interior of the charger 50 is defined by the frame 50*a*, the cover member 57*a*, and side frames 21A and 21B (FIG. 6) of the drum unit 21 opposing each other in the stretched direction of the discharge wire 52. In other words, the frame 50*a* and the side frames 21A and 21B together function as a frame of the charger 50. The interior of the charger 50 is primarily divided by a wall 50*b* into a discharge space 51 and a ventilating space 53. The discharge space 51 is elongated in the stretched direction of the discharge wire 52 for encompassing the discharge wire 52 and is open on the side facing the photosensitive drum 30. The ventilating space 53 is also formed along the stretched direction of the discharge wire 52 above the photosensitive drum 30 and the discharge space 51. The wall 50*b* is provided at the top of the discharge space 51 and on the side opposite the photosensitive drum 30. The wall 50*b* is formed with a ventilating hole 55 elongated in the stretched direction of the discharge wire 52, such that the ventilating hole 55 penetrates through the wall 50*b* in substantially the vertical direction. Thus, the discharge space 51 is in fluid communication with the ventilating space 53 through the ventilating hole 55.

Figure 4:
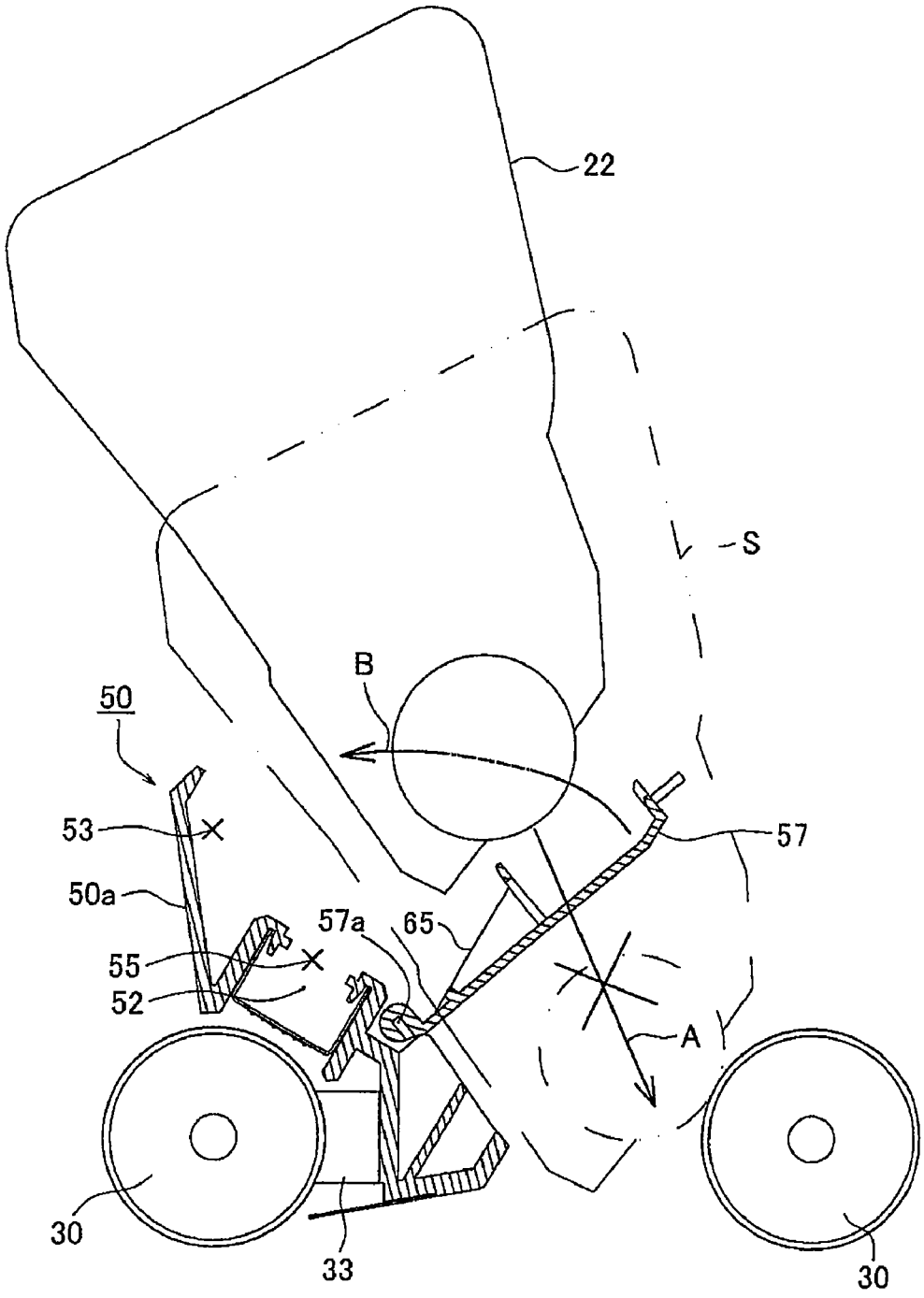
FIG. 4 is an enlarged side cross-sectional view of the photosensitive drum and the charger when a cover member of the charger is opened and a neighboring developing unit is disposed in a mounting space.

The cover member 57 can open and close by pivoting about a support point 57*a* on the lower edge thereof. When closed, the cover member 57 functions as a section of wall forming the ventilating space 53 that extends from a point below the ventilating hole 55 to the top edge of the frame 50*a*, passing over the space opposite the ventilating hole 55. As shown in FIG. 4, the cover member 57 is opened by pulling the top edge of the cover member 57 rightward so that the cover member 57 pivots about the support point 57*a* in a direction opposite a direction indicated by an arrow B. When the cover member 57 is open, the ventilating hole 55 is exposed to the external space above the ventilating space 53. With this construction, the discharge wire 52 stretched in the discharge space 51 can be viewed through the ventilating hole 55 from the ventilating space 53 side.

As shown in FIG. 4, the developing unit 22 is inserted downward in an inserting direction A and mounted in a mounting space S between neighboring photosensitive drums 30. An open position of the cover member 57 is within the mounting space S neighboring to the right of the corresponding photosensitive drum 30. The cover member 57 is closed by pivoting about the support point 57*a* in a direction B that is substantially opposite from the inserting direction A of the developing unit 22. This configuration prevents the developing unit 22 from being mounted in the mounting space S while the cover member 57 of the neighboring charger 50 is in the open position, and ensures that a user closes the cover member 57 before mounting the developing unit 22 in the mounting space S.

Figure 5:
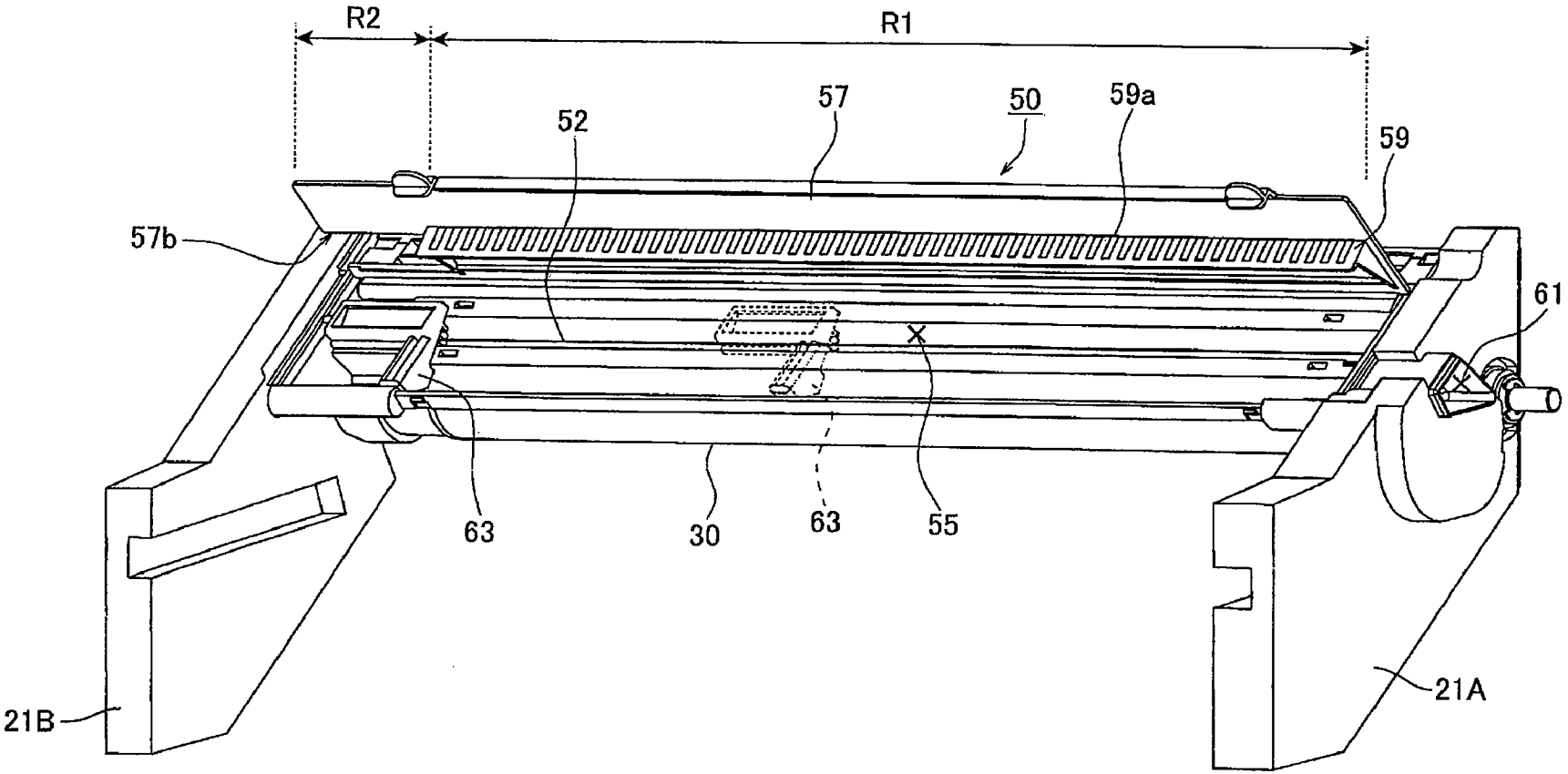
FIG. 5 is a perspective view from above showing the charger and the neighboring parts with a cover member being open.

As shown in FIG. 3, the cover member 57 is integrally formed with a partitioning piece 59 on the ventilating space 53 side of the wall surface. The partitioning piece 59 has an elongated shape extending in the stretched direction of the discharge wire 52. When the cover member 57 is closed, the partitioning piece 59 locates on the side of the discharge space 51 along a rotational direction γ of the photosensitive drum 30, partitioning the ventilating space 53 into a discharge-space side 53*a* and a non-discharge-space side 53*b*. As shown in FIG. 5, a plurality of through-holes 59*a* is formed in the partitioning piece 59 in a row along the stretched direction of the discharge wire 52. Each through-hole 59*a* is slit-shaped and has a width of 3 mm in the stretched direction of the discharge wire 52.

As shown in FIG. 5, the charger 50 further includes a wire cleaner 63. The wire cleaner 63 is mounted in the ventilating hole 55 so as to be able to slide in the longitudinal direction of the ventilating hole 55. Here, the discharge wire 52 spans an image-forming region R1 and a non-image-forming region R2 on one end of the image-forming region R1 along the stretched direction of the discharge wire 52, but outside of the image-forming region R1. The discharge wire 52 produces a discharge for the photosensitive drum 30 within the image-forming region R1, but does not produce within the non-image-forming region R2. The ventilating hole 55 is formed with sufficient length to allow the wire cleaner 63 to move between one end of the image-forming region R1 opposite the non-image-forming region R2 (right end in FIG. 5) and a storing position in the non-image-forming region R2.

Figure 6:
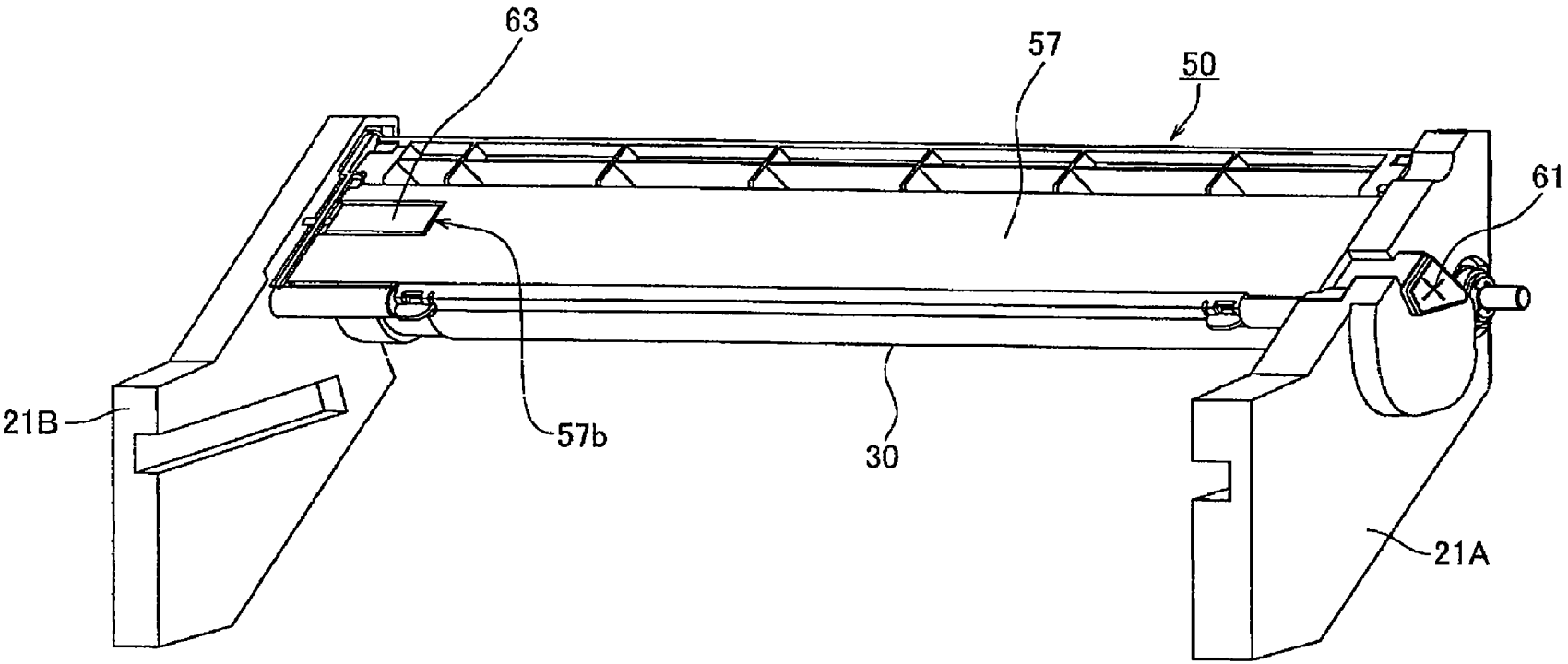
FIG. 6 is a perspective view from above the charger and the neighboring parts with the cover member being closed.

The partitioning piece 59 extends within the image forming region R1 but not in the non-image-forming region R2. As shown in FIGS. 5 and 6, a loose-fitting cutout portion 57*b* is formed in the cover member 57. The cutout portion 57*b* is open on the side opposite the partitioning piece 59 (left side in FIG. 5) and loosely fits over the wire cleaner 63 when the wire cleaner 63 is in the storing position and the cover member 57 is closed.

Figure 7A:
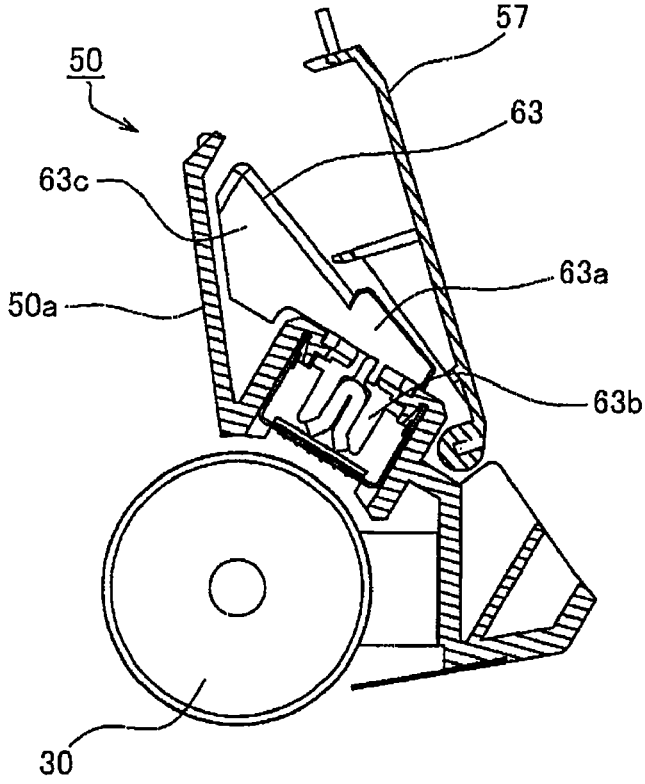
FIG. 7(*a*) is an enlarged side cross-sectional view of the photosensitive drum and the charger with the cover member being incompletely closed.
Figure 7B:
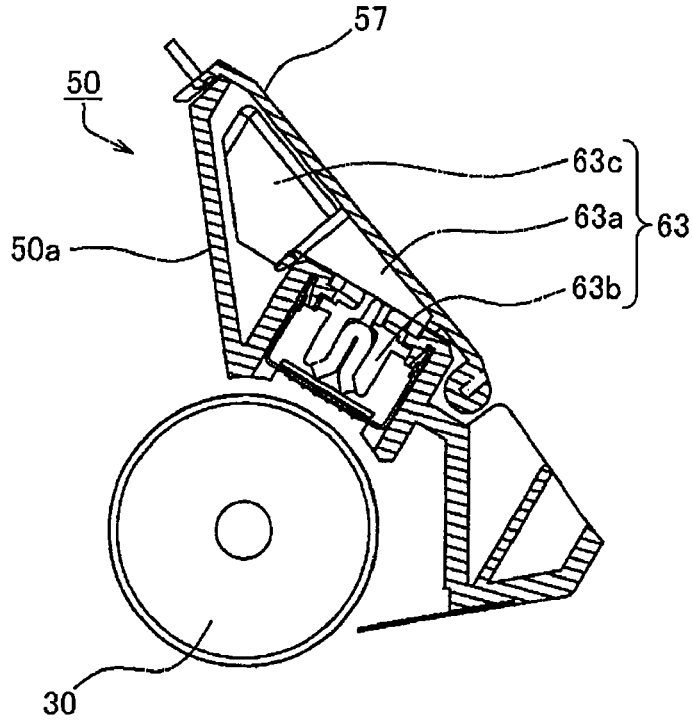

As shown in FIG. 7(*a*), the wire cleaner 63 includes a principal part 63*a*, a cleaning part 63*b*, and a grip part 63*c*. The cleaning part 63*b* is disposed on a lower end of the principal part 63*a* and positioned within the discharge space 51 for gripping and cleaning the discharge wire 52. The grip part 63*c* is disposed in the non-discharge-space side 53*b* of the ventilating space 53. By a user gripping the grip part 63*c* and sliding the wire cleaner 63 along the longitudinal direction of the ventilating hole 55, the cleaning part 63*b* slides over and cleans the discharge wire 52. In this manner, foreign matter can be removed from the discharge wire 52.

Since the cleaning part 63*b* of the wire cleaner 63 contacts the discharge wire 52, the discharge wire 52 will not properly produce a corona discharge in the area contacted by the wire cleaner 63 if the laser printer 1 is operated while the wire cleaner 63 should not be positioned within the image-forming region. Therefore, the wire cleaner 63 cannot be positioned within the image-forming region when the laser printer 1 is operated.

However, as shown in FIG. 7(*a*), the partitioning piece 59 and the grip part 63*c* abut against each other and prevent the cover member 57 from closing when the wire cleaner 63 is positioned within the image-forming region R1 as indicated by a dotted line in FIG. 5. On the other hand, when the wire cleaner 63 is in the storing position indicated by the solid line in FIG. 5, the grip part 63*c* does not abut against the partitioning piece 59 even when a user tries to close the cover member 57 because the partitioning piece 59 does not extend as far as the storing position of the wire cleaner 63. Thus, the cutout portion 57*b* fits over the wire cleaner 63, enabling the cover member 57 to close, as shown in FIGS. 6 and 7(*b*).

Hence, the user can determine whether the wire cleaner 63 has been moved outside of the image-forming region R1 by whether the cover member 57 can be closed. This configuration prevents the user from forgetting to retract the wire cleaner 63 from the image-forming region R1.

As shown in FIG. 5, an inlet 61 is formed in the side frame 21A so as to be in fluid communication with the non-discharge-space side 53*b* of the ventilating space 53. The inlet 61 draws external air into the ventilating space 53 along the stretched direction of the discharge wire 52, functioning as a duct.

When external air is drawn through the inlet 61 into the non-discharge-space side 53*b* of the ventilation space 53, the air flows from the non-discharge-space side 53*b* to the discharge-space side 53*a* through the through-holes 59*a*, as indicated by the arrow Y1 in FIG. 3. At this time, by passing through the through-holes 59*a*, the air is regulated to flow into the discharge-space side 53*a* in parallel streams. This regulated airflow flows into the discharge space 51 via the ventilating hole 55, as indicated by an arrow Y2 in FIG. 3, and strikes the discharge wire 52 uniformly, thereby more effectively preventing foreign matter from becoming deposited on the discharge wire 52 than a structure that does not employ the through-holes 59*a*.

Also, since the inlet 61 draws air into the non-discharge-space side 53*b* of the ventilating space 53 along the stretched direction of the discharge wire 52, a negative pressure is generated in the discharge-space side 53*a* of the ventilating space 53, that is, on the underside of the partitioning piece 59. This negative pressure causes air flowing through the non-discharge-space side 53*b* to bend toward the discharge-space side 53*a* and blow forcefully through the through-holes 59*a* into the discharge-space side 53*a*. Moreover, the air is blown in parallel streams formed along the entire stretched direction of the discharge wire 52 so that forced streams of air strike the discharge wire 52 uniformly over the entire length thereof. This structure can more effectively prevent foreign matter from becoming deposited on the discharge wire 52 than a structure that does not blow air through the through-holes 59*a* in parallel streams.

Since it is ensured that the cover member 57 is closed as described above, and since the cover member 57 can be closed to ensure a reliable air flow from the ventilating space 53 to the discharge space 51, it is possible to reliably reduce the amount of foreign matter deposited on the discharge wire 52.

It should be noted that the airflow struck the discharge wire 52 disperses in the stretched direction of the discharge wire 52, passes between the frame 50*a* and the photosensitive drum 30, and then goes upward past the frame 50*a*.

It should be noted also that the width of the through-holes 59*a* are not limited to 3 mm, but are preferably no less than 1 mm and no greater than 5 mm. If the width is greater than 5 mm, the generated negative pressure becomes too large, producing a back flow in which air expelled outward strikes the photosensitive drum 30 and returns into the discharge space 51, resulting in a larger amount of foreign matter becoming deposited on the discharge wire 52. On the other hand, if the width is less than 1 mm, air will have difficulty passing through the through-holes 59*a* resulting in an insufficient flow rate for preventing the deposition of foreign matter on the discharge wire 52.

It is conceivable to position the partitioning piece 59 in a location on the opposite side of the discharge space 51 from the photosensitive drum 30. However, when the partitioning piece 59 is disposed in this location, the photosensitive drum 30, the discharge space 51, and the partitioning piece 59 are arranged along a straight line, making a more bulky construction and increasing the size of the charger 50. By disposing the partitioning piece 59 on the side of the discharge space 51 with respect to the rotational direction $\gamma$ of the photosensitive drum 30, the photosensitive drum 30, the discharge space 51, and the partitioning piece 59 can be arranged in a more compact construction. Thus, when employing the construction of the charger 50 described above, it is possible to provide the partitioning piece 59 while maintaining the compact structure of the laser printer 1.

As described above, according to the above aspects, if the user opens the cover member 57, the ventilating hole 55 is exposed to the external space above the ventilating space 53. Thus, the user can operate the wire cleaner 63 to clean the discharge wire 52.

Next, a laser printer according to second illustrative aspects of the invention will be described with reference to FIGS. 8(*a*) and 8(*b*). The following description focuses on points of the construction according to the second illustrative aspects that differ from the construction according to the above-described aspects.

Figure 8A:
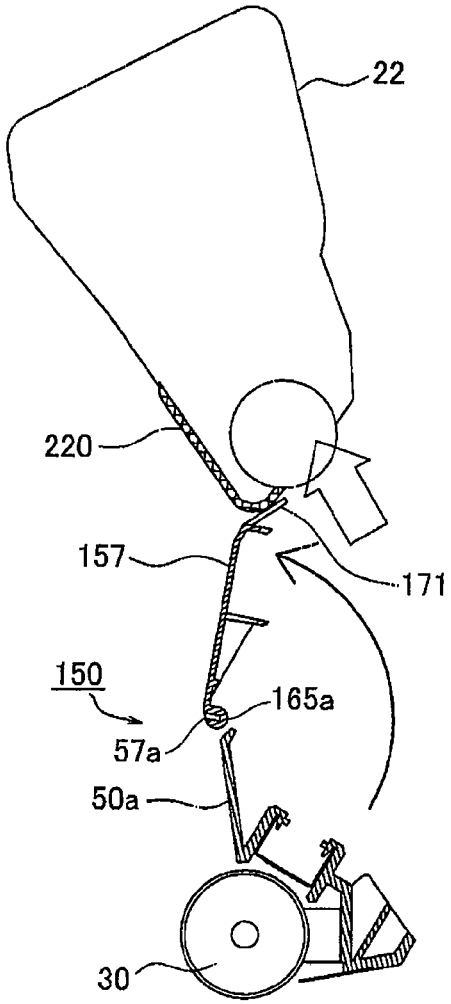
FIG. 8(*a*) is an enlarged side cross-sectional view of the photosensitive drum and a Scorotron charger provided in a laser printer according to second illustrative aspects with a cover member being open.
Figure 8B:
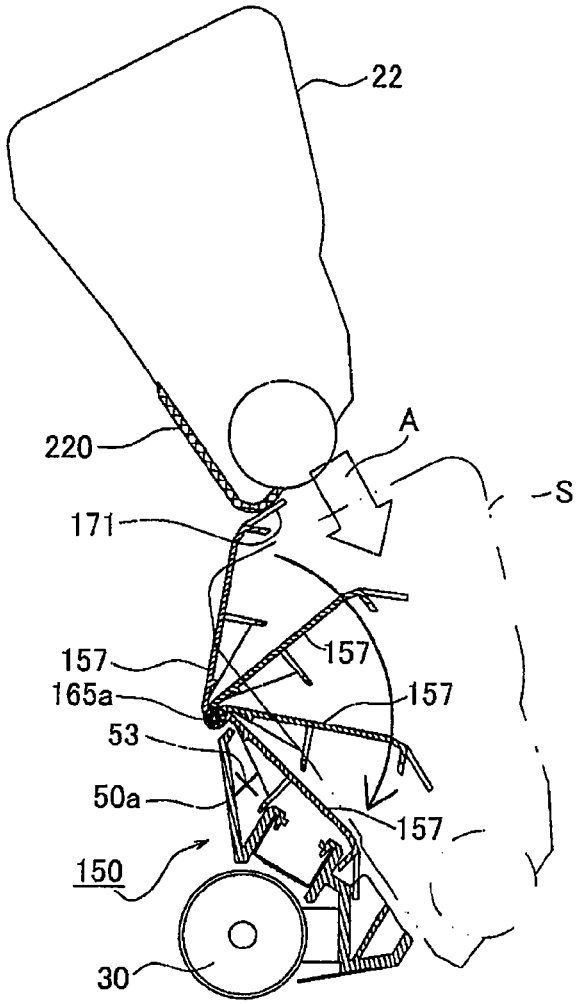

As shown in FIG. 8(*a*), a Scorotron charger 150 provided in a laser printer according to the second illustrative aspects includes a torsion coil spring 165*a* disposed at the support point 57*a* of a cover member 157. The torsion coil spring 165*a* urges the free end of the cover member 157 upward, so that the cover member 157 pivots open about the support point 57*a* at the top point of the frame 50*a*. Hence, as shown in FIG. 8(*b*), the cover member 157 closes over the ventilating space 53 by moving the cover member 157 in substantially the same direction as the inserting direction A of the developing unit 22.

Each developing unit 22 includes a protruding part 220 at the bottom, and the cover member 157 includes a guide part 171 provided on the distal end thereof. As shown in FIG. 8(*b*), the guide part 71 is formed of a sufficient length to be positioned in an inserting path of the neighboring developing unit 22 when the cover member 57 is open. Therefore, when mounting the developing unit 22 into the neighboring mounting space S, the protruding part 220 of the developing unit 22 contacts the guide part 171, pushing the cover member 157 from the open position to the closed position. Accordingly, this construction can prevent such cases as the user forgetting to close the cover member 157, enabling automatically closing the cover member 157 when the developing unit 22 is mounted in the mounting space S.

Moreover, because the torsion coil spring 165*a* urges the free end of the cover member 157 toward the open position, when the developing unit 22 is removed from the neighboring mounting space S, the cover member 157 automatically opens due to the urging force of the torsion coil spring 165*a*. This configuration removes the need to always open the cover member 157 to clean the discharge wire 52, thereby reducing the number of steps in the cleaning operation for the discharge wire 52 and improving the efficiency of the cleaning operation.

Next, a laser printer according to third illustrative aspects of the invention will be described with reference to FIGS. 9(*a*) and 9(*b*). The following description focuses on points of the construction according to the third illustrative aspects that differ from the construction according to the above-described second illustrative aspects.

Figure 9A:
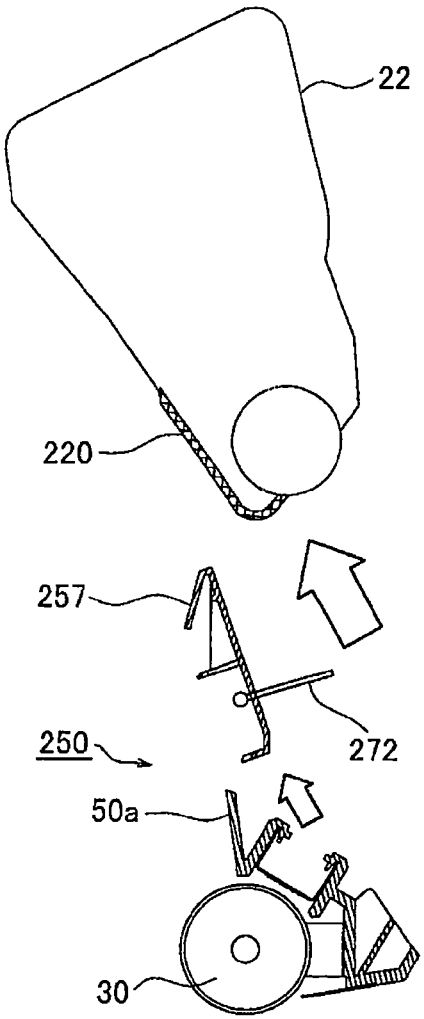
FIG. 9(*a*) is an enlarged side cross-sectional view of the photosensitive drum and a Scorotron charger provided in a laser printer according to third illustrative aspects of the invention with a cover member being open.
Figure 9B:
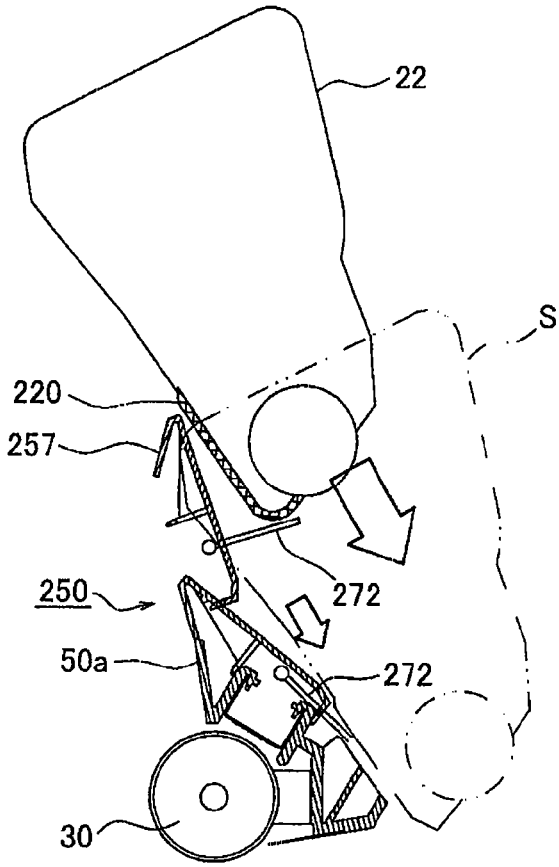

As shown in FIG. 9(*a*), a Scorotron charger 250 according to the third illustrative aspects is configured so that a cover member 257 can move slidingly upward along a guide member (not shown). A guide part 272 is disposed on the neighboring developing unit 22 side (right side in FIG. 9(*a*) of the cover member 257 near the vertical center of the cover member 257. The guide part 272 lies on the inserting path of the protruding part 220 of the neighboring developing unit 22, when the cover member 257 is in the open state.

Hence, as shown in FIG. 9(*b*), when the developing unit 22 moves toward the mounted position S, the protruding part 220 presses against the guide part 272, moving the cover member 257 from the open position to the closed position. When the developing unit 22 is positioned in the mounting space S, the guide part 272 pivots such that the free end thereof moves downward and is folded up on the charger 250 side.

Hence, the guide part 272 is contacted by the developing unit 22 when the developing unit 22 is mounted in the mounting space S, thereby reliably closing the cover member 257. Therefore, it is possible to mount the developing unit 22 in the mounting space S without closing the cover member 257.

Although not shown in the drawings, the guide part 272 is also provided with two urging parts. One of the urging parts slides the cover member 257 upward to open the ventilating space 53 when the developing unit 22 is removed from the neighboring mounting space S, as shown in FIG. 9(*a*). The other urging part urges the folded guide part 272 to a position in the inserting path of the developing unit 22 when the developing unit 22 is removed from the neighboring mounting space S.

Next, a laser printer according to fourth illustrative aspects of the invention will be described with reference to FIGS. 10(*a*) and 10(*b*). The following description focuses on points of the construction according to the fourth illustrative aspects that differ from the construction according to the above-described third illustrative aspects.

A Scorotron charger 350 according to the fourth illustrative aspects differs from the first through third illustrative aspects described above primarily in that a cover member 357 is opened and closed using the corresponding developing unit 22 rather than a neighboring developing unit 22.

Figure 10B:
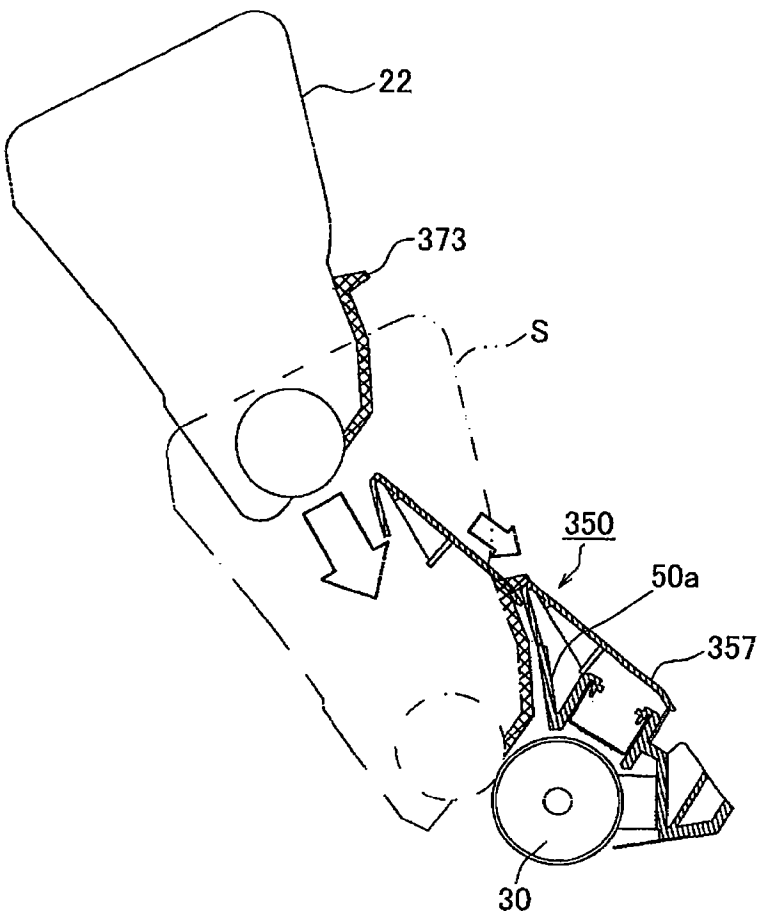
FIG. 10(*a*) is an enlarged side cross-sectional view of the photosensitive drum and a Scorotron charger provided in a laser printer according to fourth illustrative aspects of the invention when a cover member is open.
Figure 10A:
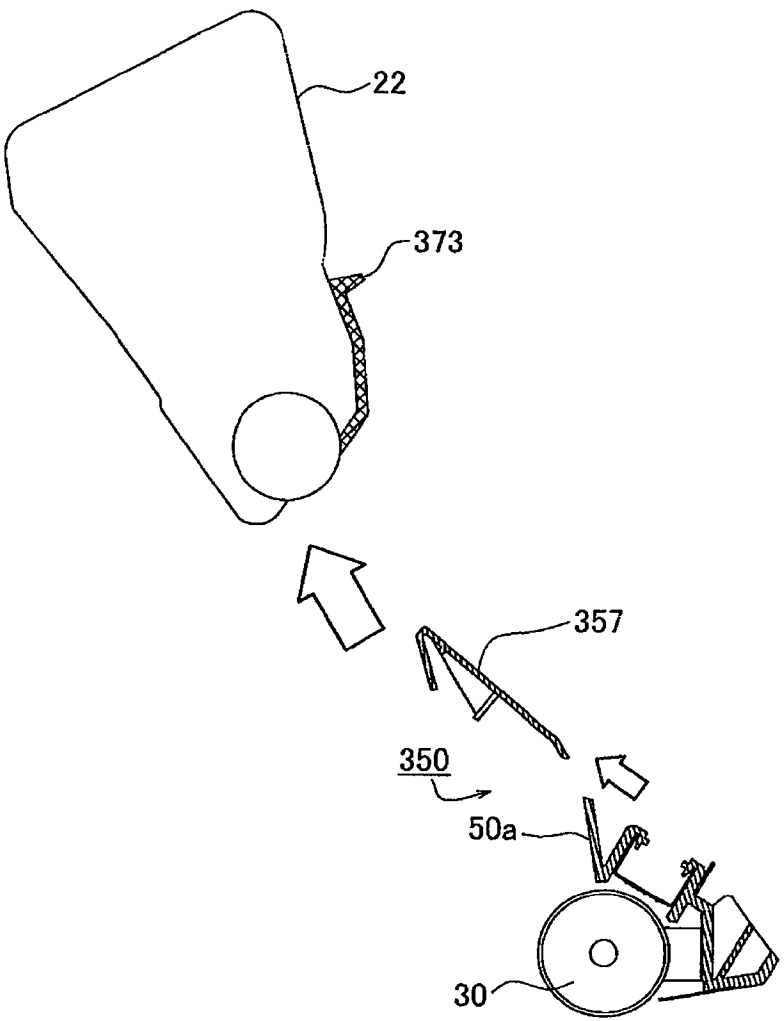

As shown in FIGS. 10(*a*) and 10(*b*), the charger 350 is configured so that the cover member 357 is capable of moving slidingly upward along a guide member (not shown). A guide protrusion 373 is provided on the surface of the developing unit 22 facing the charger 350 side. When the cover member 357 is in the open position, the top of the cover member 357 is positioned on the path of the guide protrusion 373 when the developing unit 22 is inserted toward the mounting space S.

With this configuration, the guide protrusion 373 catches on the cover member 357 and reliably pushes the cover member 357 closed when the developing unit 22 is mounted in the mounting space S. Accordingly, it is possible to mount the developing unit 22 in the mounting space S without closing the cover member 357.

The charger 350 is also provided with an urging unit (not shown). The urging unit urges the cover member 357 to slide upward when the developing unit 22 is removed from the mounting space S, as shown in FIG. 10(*a*), so that the top of the cover member 357 is positioned in the path of the guide protrusion 373.

Although not shown in the drawings, the cover member 357 is formed with a cutout portion corresponding to the cutout portion 57*b* in FIG. 5. However, the cutout portion of the cover member 357 should be open in the sliding direction of the cover member 357 such that the cutout portion fits over the wire cleaner 63 when the cover member 357 slides to be closed.

Next, a laser printer according to fifth illustrative aspects of the invention will be described with reference to FIGS. 11(*a*) and 11(*b*). The following description focuses on points of the construction according to the fifth illustrative aspects that differ from the construction according to the above-described first illustrative aspects.

Figure 11A:
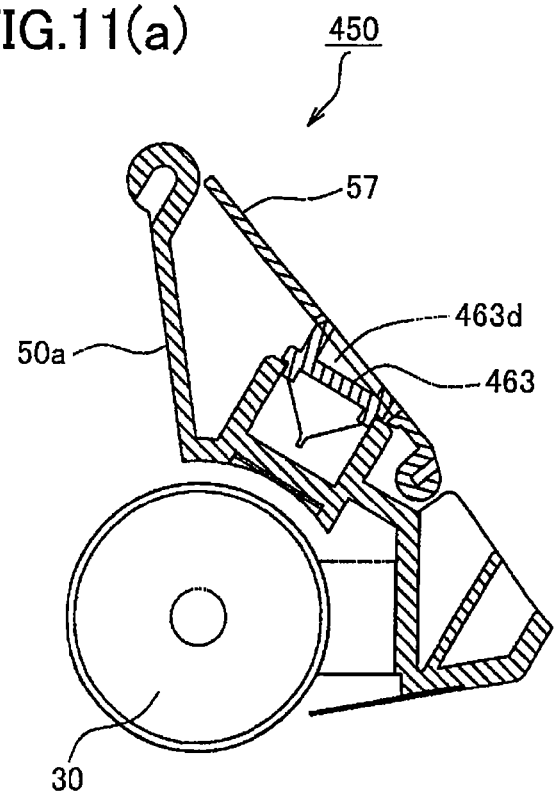
FIG. 11(*a*) is an enlarged side cross-sectional view of the photosensitive drum and a Scorotron charger provided in a laser printer according to fifth illustrative aspects of the invention when the cover member is incompletely closed.
Figure 11B:
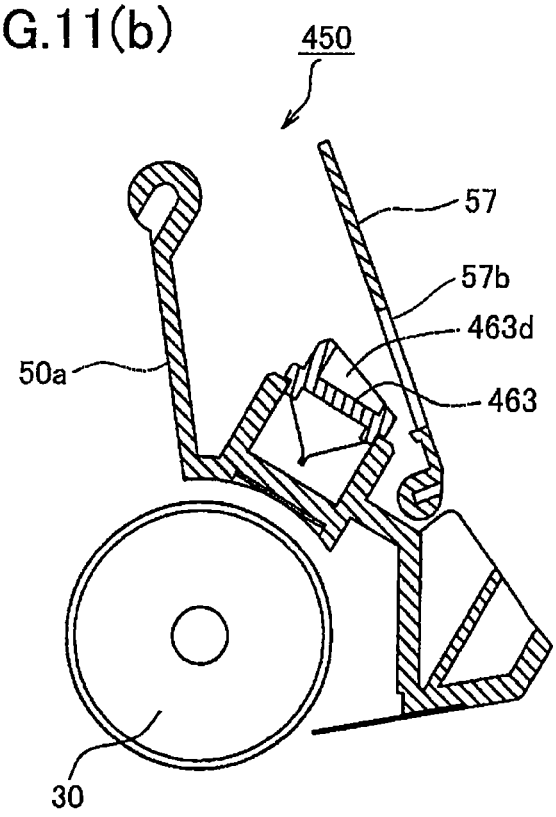

In the fifth illustrative aspects, as shown in FIG. 11(*a*), a wire cleaner 463 of a charger 450 includes a protruding part 463*d* instead of a grip part 63*c*. The protruding part 463*d* is disposed on top of the principal part 63*a* and prevents the cover member 57 from closing when the wire cleaner 463 is positioned within the image-forming region R1. However, the protruding part 463*d* fits into the cutout portion 57*b* when the wire cleaner 463 is in the storing region, enabling the cover member 57 to close as shown in FIG. 11(*b*).

Therefore, with this configuration also, it is possible to prevent the user from forgetting to return the wire cleaner 463 to the storing position.

Next, a laser printer 501 according to sixth illustrative aspects of the invention will be described with reference to FIGS. 12 to 14. The following description focuses on points of the construction according to the fourth illustrative aspects that differ from the construction according to the above-described first illustrative aspects.

Figure 12:
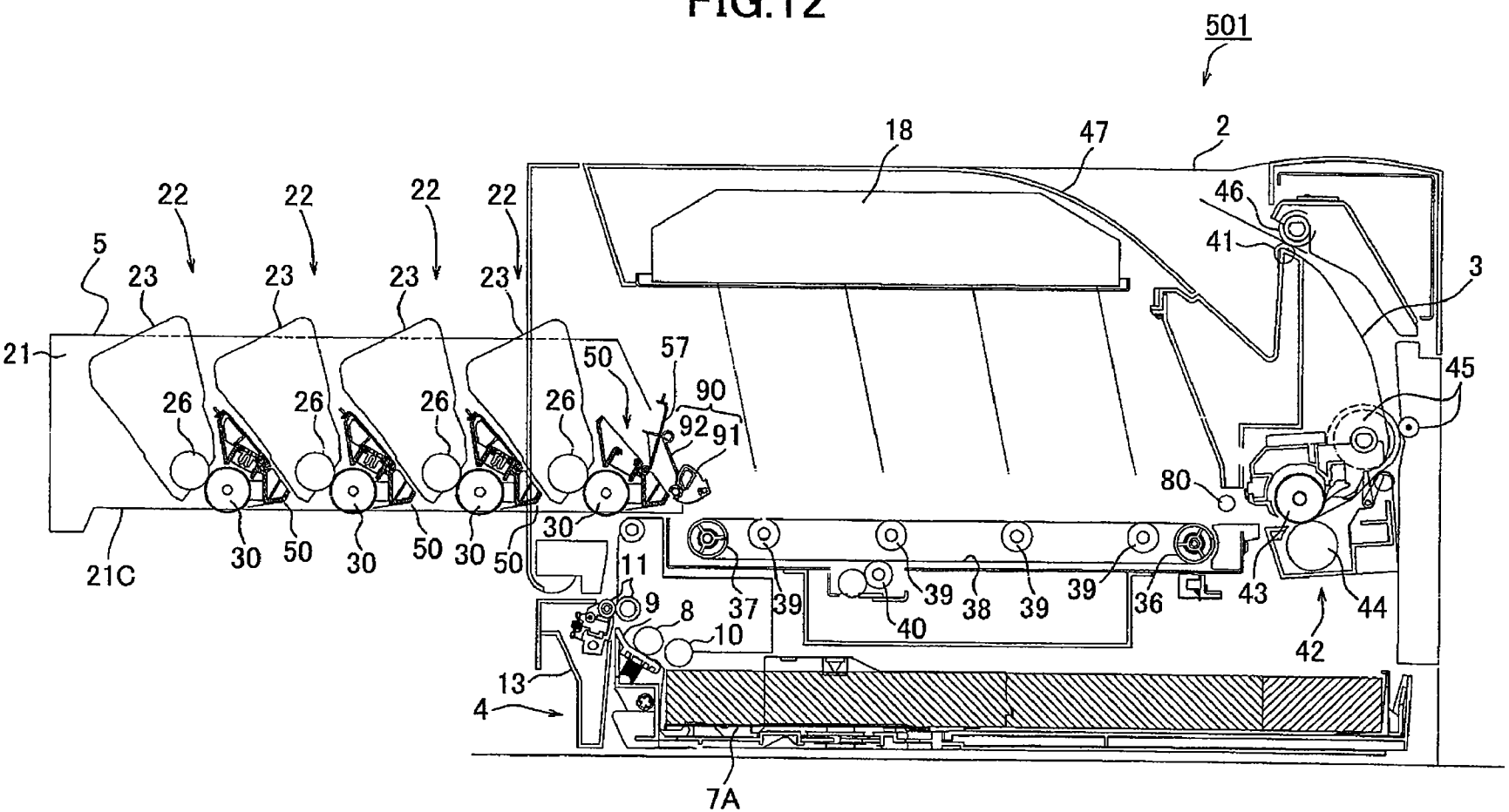
FIG. 12 is a schematic diagram showing the structure of a laser printer according to sixth illustrative aspects of the invention, illustrating the mounting of a drum unit in a main casing of the laser printer.

As shown in FIG. 12, the laser printer 501 differs in structure from the above-described laser printer 1 in FIG. 1 in having a first closing member 80 provided in the main casing 2 and a second closing member 90 provided on a main frame 21C of the drum unit 21.

Figure 14:
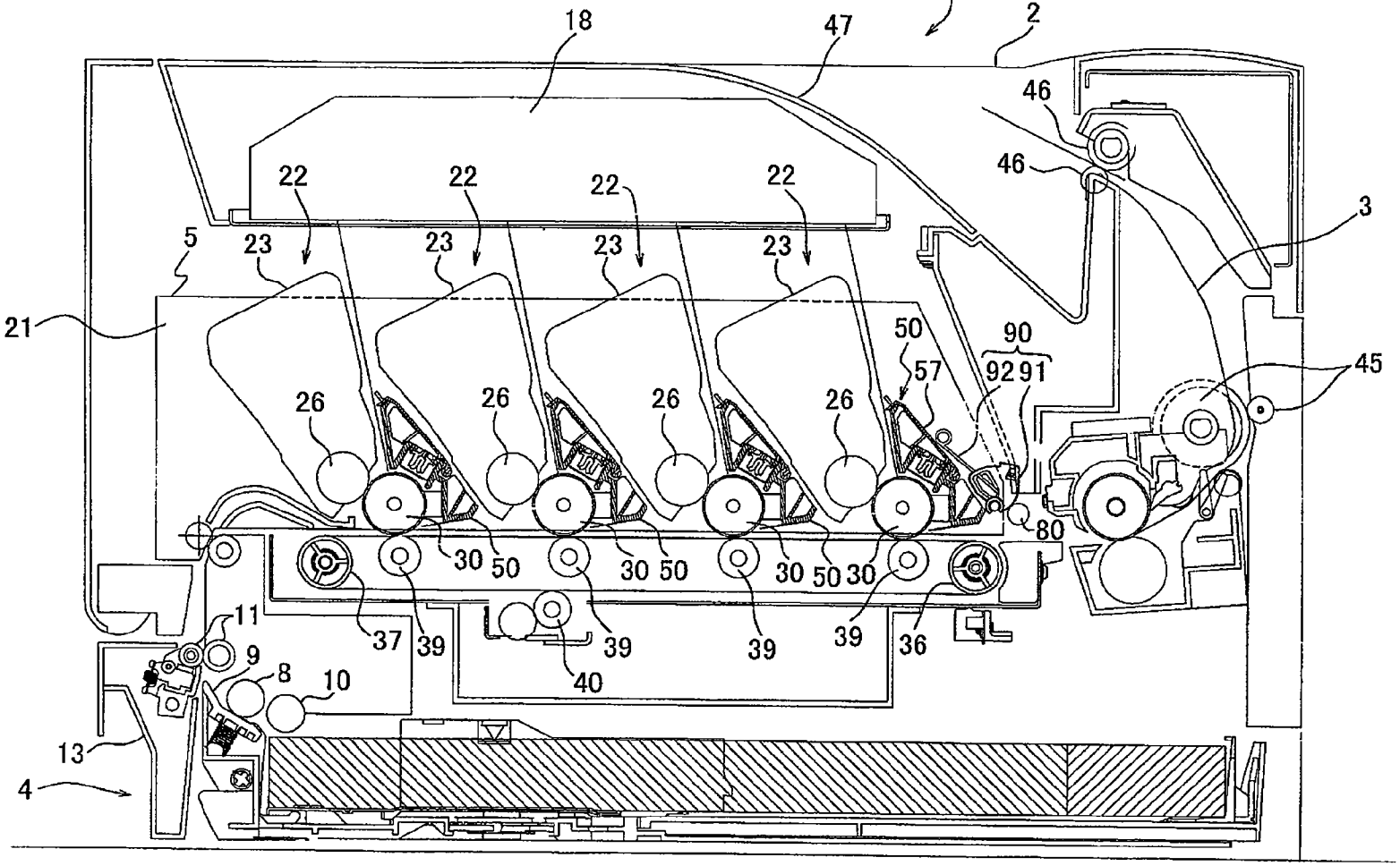
FIG. 14 is a schematic diagram showing the structure of the laser printer in FIG. 12 and illustrating the mounting of the drum unit in the main casing.

The drum unit 21 can be mounted in and removed from the main casing 2 by being moved horizontally between a detached position shown in FIG. 12 and a mounted position shown in FIG. 14. The drum unit 21 can also be completely removed from the main casing 2 from the detached position.

The first closing member 80 is configured of a metal bar disposed at a position opposing the leading end of the drum unit 21 when the drum unit 21 is in the mounted position in the main casing 2, where the leading end is the downstream end in the mounting direction of the drum unit 21. The first closing member 80 is oriented parallel to the transfer rollers 39 and the like.

The second closing member 90 is disposed on the leading end of the main frame 21C of the drum unit 21 and in the widthwise center thereof. The second closing member 90 includes a contact part 91 and a spring 92. As shown in FIG. 13, the contact part 91 is mounted at a position for contacting the first closing member 80 when the drum unit 21 is accommodated in the main casing 2. The contact part 91 is pivotable about an axis parallel to the transfer rollers 39 between a released position shown in FIG. 12 and a contact position shown in FIG. 14. The spring 92 is a bar-shaped spring extending upward from the top of the contact part 91 so that the free end of the spring 92 contacts the cover member 57 in the open state.

Figure 13:
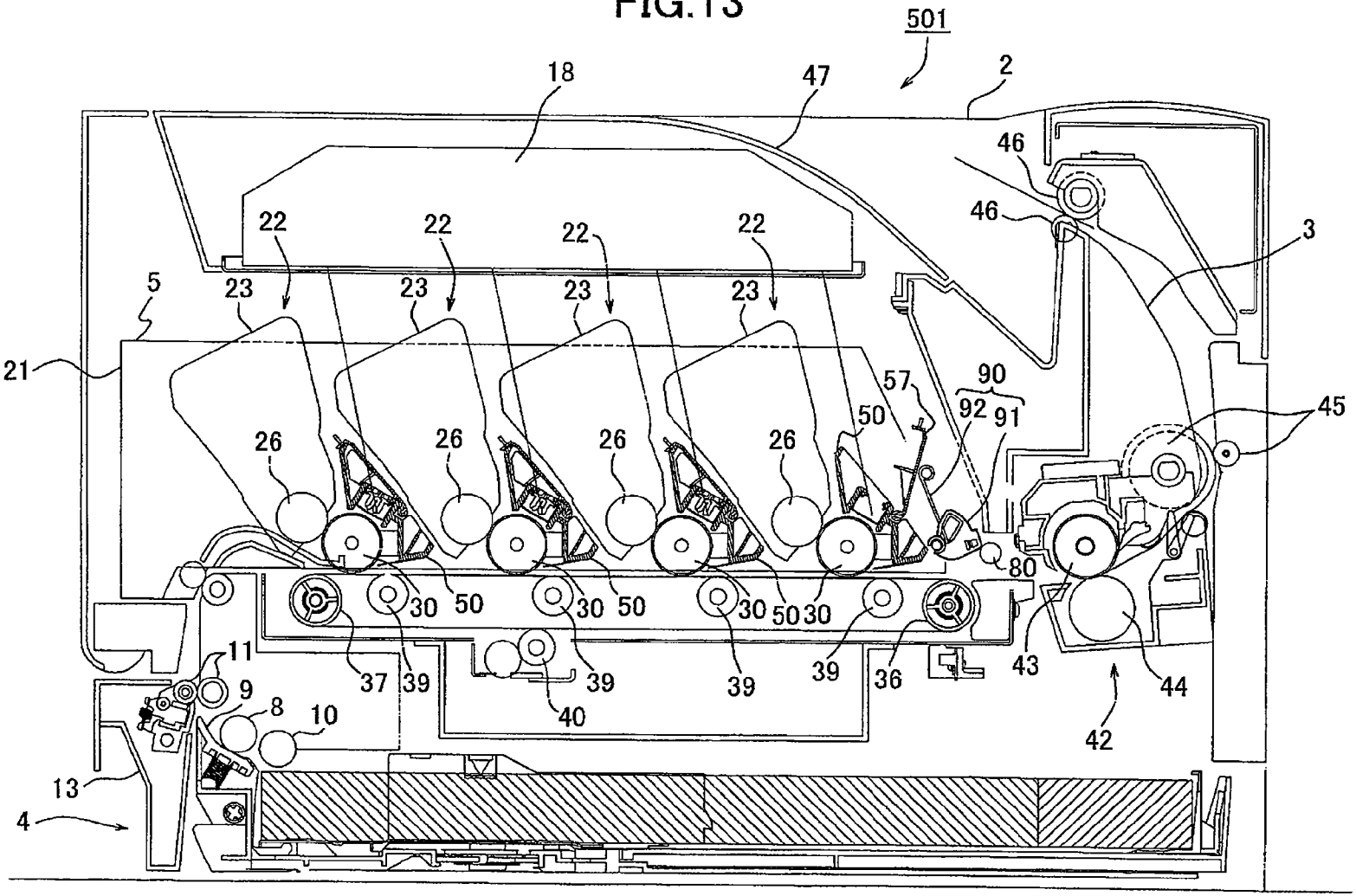
FIG. 13 is a schematic diagram showing the structure of the laser printer in FIG. 12 and illustrating the mounting of the drum unit in the main casing.

With this configuration, when the drum unit 21 is moved from the detached position toward the mounted position, the contact part 91 of the second closing member 90 contacts the first closing member 80 just prior to the mounted position, as shown in FIG. 13. As the drum unit 21 is moved further toward the mounted position, the contact part 91 pivots, causing the spring 92 to also pivot. As shown in FIG. 14, the spring 92 elastically deforms and causes the cover member 57 to pivot from the open state to the closed state.

Accordingly, if the user should forget to close the cover member 57 in the leading position with respect to the mounting direction, the first closing member 80 and the second closing member 90 will close the leading cover member 57 when the drum unit 21 is mounted in the main casing 2, preventing the cover member 57 from being left unclosed.

Note that if the second closing member 90 is not provided with the spring 92 and is simply pressed by the first closing member 80 to close the cover member 57, depending on the material of the first closing member 80 there is a danger that the second closing member 90 may break unless the force of mounting the drum unit 21 in the main casing 2 is properly adjusted. However, in the laser printer 501 according to the sixth illustrative aspects, the spring 92 alleviates the force of mounting the drum unit 21 in the main casing 2, thereby preventing the second closing member 90 from breaking. Further, the cover member 57 is pressed by the elastic force of the spring 92 when the spring part 92 is elastically deformed, thereby reliably closing the cover member 57.

Next, a laser printer 601 according to seventh illustrative aspects of the invention will be described with reference to FIGS. 15 to 17. The following description focuses on points of the construction according to the seventh illustrative aspects that differ from the construction according to the above-described sixth illustrative aspects.

Figure 15:
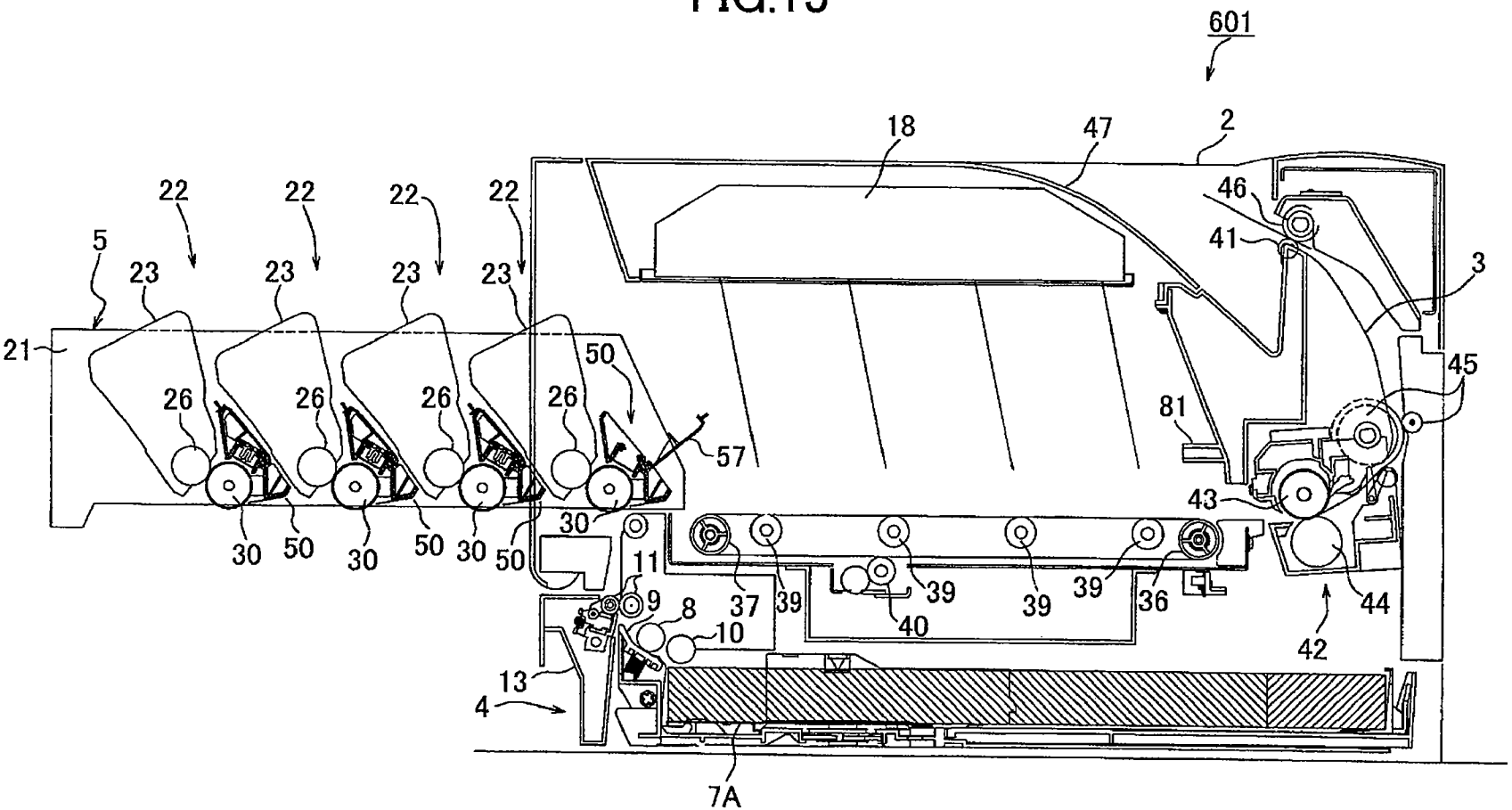
FIG. 15 is a schematic diagram showing the structure of a laser printer according to seventh illustrative aspects and illustrating the mounting of the drum unit in the main casing of the laser printer.

The laser printer 601 shown in FIG. 15 differs from the laser printer 501 shown in FIG. 12 in that the first closing member 80 and the second closing member 90 are dispensed with and, instead, a protruding part 81 is provided in the main casing 2.

The protruding part 81 is formed to protrude in a direction opposite the mounting direction of the drum unit 21. As shown in FIG. 16, the protruding part 81 is positioned so that the leading end of the protruding part 81 contacts the cover member 57 as the drum unit 21 is inserted in the main casing 2.

Figure 16:
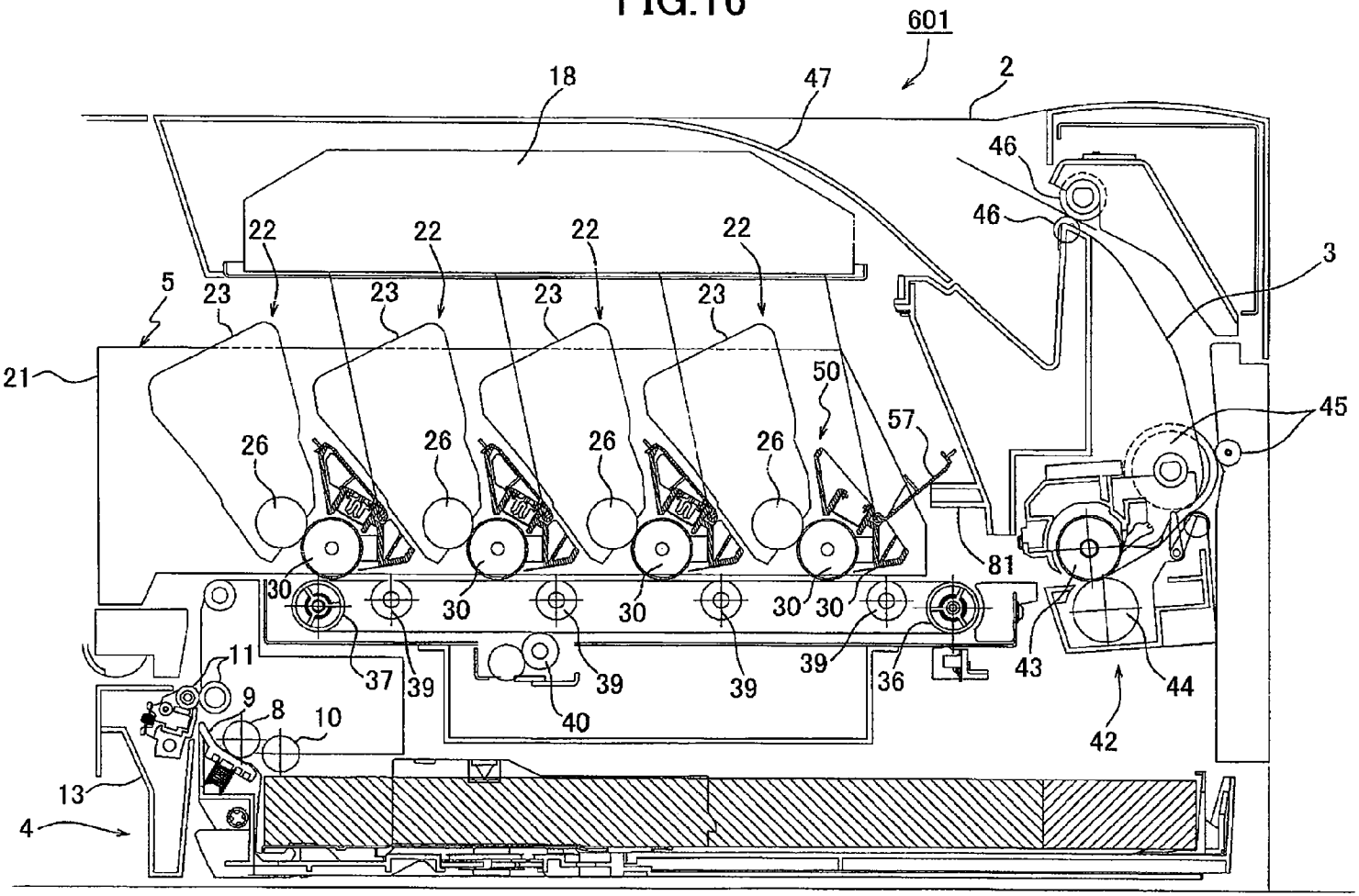
FIG. 16 is a schematic diagram showing the structure of the laser printer in FIG. 15 and illustrating the mounting of the drum unit in the main casing.
Figure 17:
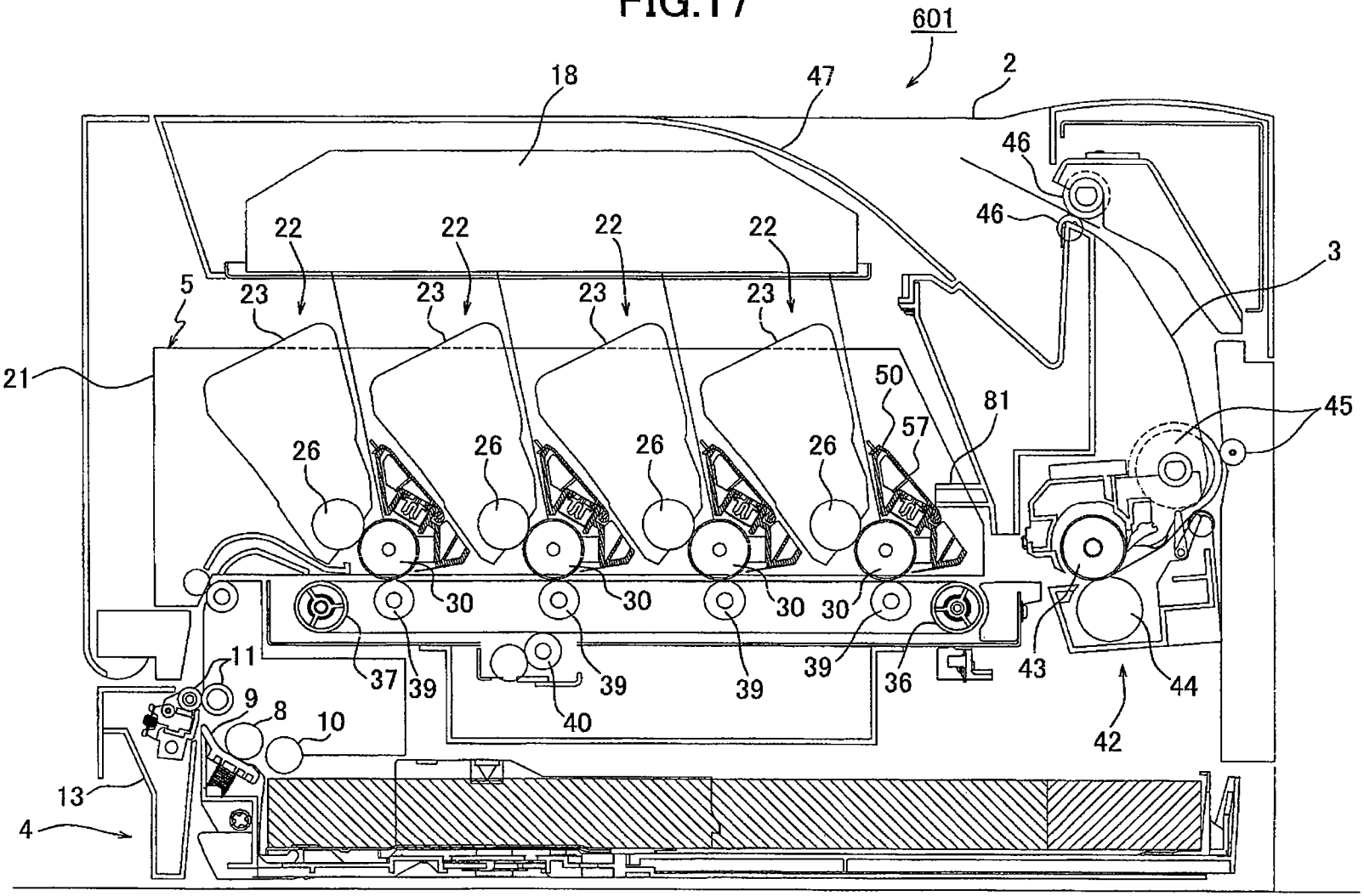
FIG. 17 is a schematic diagram showing the structure of the laser printer in FIG. 15 and illustrating the mounting of the drum unit in the main casing.

With this configuration, as the drum unit 21 moves from the detached position to the mounted position, the leading cover member 57 in an open position contacts the protruding part 81 just prior to the mounted position, as shown in FIG. 16. As the drum unit 21 is moved further into the mounted position, the cover member 57 pivots closed, as shown in FIG. 17. Hence, even if the user forgets to close the leading cover member 57, the protruding part 81 closes the cover member 57 as the drum unit 21 is mounted in the main casing 2, thereby reliably preventing the leading cover member 57 from being left open.

While the invention has been described in detail with reference to the above aspects thereof, it would be apparent to those skilled in the art that various changes and modifications may be made therein without departing from the spirit of the invention.

For example, in the above aspects, the invention is applied to a direct tandem-type printer for directly transferring toner images onto a recording medium. However, the invention can be applied to an intermediate transfer type color laser printer for transferring the toner images onto the recording medium via an intermediate transfer member, such as an intermediate transfer belt or an intermediate transfer roller. In addition to paper, the recording medium on which images are recorded may be a transparency or other plastic sheet, a fabric medium, or the like.

What is claimed is:

1. An image-forming apparatus comprising:

an image-carrying member having a surface on which an electrostatic latent image is formed, the image-carrying member having an axis extending in a predetermined direction; and a charger including:

a discharge wire that is stretched in the predetermined direction and that produces a discharge toward the surface of the image-carrying member;

a frame that is open on a side facing the image-carrying member and that extends in the predetermined direction;

a partitioning wall partitioning an internal space of the frame into a discharge space and a ventilating space above the image-carrying member and the discharge space, the partitioning wall being formed with a ventilating hole extending along the predetermined direction and providing communication between the discharge space and the ventilating space, wherein the discharge wire is disposed within the discharge space; and a cover that is movable between a closed position and an open position, the cover in the closed position closing over the ventilating space, the cover in the open position exposing the ventilating hole to an external space above the ventilating space.

2. The image-forming apparatus according to claim 1, wherein: the charger further includes a partitioning member that partitions the ventilating space into a first side and a second side when the cover is closed, the partitioning member being formed with a plurality of through-holes aligned in the predetermined direction; and the frame is formed with an air introducing port on the first side of the ventilating space for drawing air into the ventilating space.

3. The image-forming apparatus according to claim 2, wherein the air introducing port draws air into the first side of the ventilating space along the predetermined direction.

4. The image-forming apparatus according to claim 1, wherein the charger further includes:

a cleaner that cleans the discharge wire, the cleaner being movable between one end of a predetermined region and opposite end of the predetermined region in the predetermined direction, the predetermined region including an image-forming region in which the discharge wire produces a discharge for the image-carrying member and a storing area that is outside of the image-forming region; and a stopping mechanism that stops the cover from being closed when the cleaner is positioned within the image-forming region.

5. The image-forming apparatus according to claim 1, comprising a plurality of image-carrying members that correspond to respective colors and a plurality of chargers in one-to-one correspondence with the image-carrying members.

6. The image-forming apparatus according to claim 1, further comprising another image-carrying member and a developing unit that supplies a developer to the other image-carrying member to develop an electrostatic latent image on a surface of the other image-carrying member into a visible image, wherein:

the developing unit is detachably accommodated in an accommodating space by being inserted in an inserting direction;

the open position of the cover is within the accommodating space; and the cover moves from the open position to the closed position in a closing direction different from the inserting direction of the developing unit.

7. The image-forming apparatus according to claim 1, wherein the charger further includes an urging mechanism that urges the cover from the closed position to the open position.

8. The image-forming apparatus according to claim 1, further comprising a developing unit that supplies developer to the image-carrying member to develop the electrostatic latent image on the surface of the image-carrying member into a visible image, wherein:

the developing unit is detachably accommodated in an accommodating space by being inserted in an inserting direction;

the open position of the cover is within the accommodating space; and the cover moves from the open position to the closed position in a closing direction that is substantially the same as the inserting direction of the developing unit.

9. The image-forming apparatus according to claim 8, wherein the cover includes a guide part positioned on a path in which the developing unit moves toward the accommodating space when the cover is in the open position, and the developing unit pushes against the guide part when moving toward the accommodating space, moving the cover from the open position to the closed position.

10. The image-forming apparatus according to claim 9, wherein the developing unit includes a pressing part that presses the guide part when the developing unit moves toward the accommodating space.

11. The image-forming apparatus according to claim 1, further comprising another image-carrying member and a developing unit that supplies a developer to the other image-carrying member to develop an electrostatic latent image on a surface of the other image-carrying member into a visible image, wherein:

the developing unit is detachably accommodated in an accommodating space by being inserted in an inserting direction;

the open position of the cover is within the accommodating space; and the cover moves from the open position to the closed position in a closing direction that is substantially the same as the inserting direction of the developing unit.

12. The image-forming apparatus according to claim 11, wherein the cover includes a guide part positioned on a path in which the developing unit moves toward the accommodating space when the cover is in the open position, and the developing unit pushes against the guide part when moving toward the accommodating space, moving the cover from the open position to the closed position.

13. The image-forming apparatus according to claim 12, wherein the developing unit includes a pressing part that presses the guide part when the developing unit moves toward the accommodating space.

14. The image-forming apparatus according to claim 1, further comprising:

a main casing;

an image-carrying unit including the image-carrying member and the charger and being movable between a mounted position in the main casing and a detached position outside the main casing; and a closing member that contacts the cover in the open position and moves the cover from the open position to the closed position as the image-carrying unit moves from the detached position to the mounted position.

15. The image-forming apparatus according to claim 14, wherein the closing member is a protrusion provided in the main casing at a position opposing the cover.

16. The image-forming apparatus according to claim 14, wherein the closing member includes a first closing member mounted in the main casing and a second closing member mounted on the image-carrying unit, wherein when the first closing member contacts the second closing member as the image-carrying unit moves from the detached position to the mounted position, the second closing member contacts the cover in the open position to move the cover from the open position to the closed position.

17. The image-forming apparatus according to claim 16, wherein the second closing member includes a contact part that contacts the first closing member and a spring attached to the contact part, the spring elastically deforming when the contact part contacts the first closing member and moving the cover to the closed position by an elastic force generated through the elastic deformation.

18. The image-forming apparatus according to claim 16, wherein the second closing member is provided at a downstream side of the image-carrying unit in a direction that the image-carrying unit moves from the detached position to the mounted position.

19. An image-carrying unit that is detachably mountable on a main body of an image-forming apparatus by moving toward a mounting position within the main body, the image carrying unit comprising:

an image-carrying member having a surface on which an electrostatic latent image is formed, the image-carrying member having an axis extending in a predetermined direction; and a charger including:

a discharge wire that is stretched in the predetermined direction and that produces a discharge toward the surface of the image-carrying member;

a frame that is open on a side facing the image-carrying member and that extends in the predetermined direction;

a partitioning wall partitioning an internal space of the frame into a discharge space and a ventilating space above the image-carrying member and the discharge space, the partitioning wall being formed with a ventilating hole extending along the predetermined direction and providing communication between the discharge space and the ventilating space, wherein the discharge wire is disposed within the discharge space; and a cover that is movable between a closed position and an open position, the cover in the closed position closing over the ventilating space, the cover in the open position exposing the ventilating hole to an external space above the ventilating space.

20. A developing unit that is mountable in and removed from an accommodating space within a casing of an image-forming apparatus including: an image-carrying member having a surface on which an electrostatic latent image is formed; a frame defining a discharge space and a ventilating space; a discharge wire that produces a discharge toward the surface of the image-carrying member and that is disposed within the discharge space; and a cover that is opened and closed over the ventilating space, the developing unit comprising:

a developing member that supplies a developer to the image-carrying member to develop the electrostatic latent image on the surface of the image-carrying member into a visible image; and a pressing member that presses and closes the cover of the image-forming apparatus when the developing unit is moved toward the accommodating space so as to be mounted in the accommodating space.

21. The developing unit according to claim 20, wherein the pressing member is a protrusion.

22. A developing unit that is mountable in and removed from an accommodating space within a casing of an image-forming apparatus including: a first image-carrying member having a surface on which an electrostatic latent image is formed; a second image-carrying member having a surface on which an electrostatic latent image is formed; a frame defining a discharge space and a ventilating space; a discharge wire that produces a discharge toward the surface of the first image-carrying member and that is disposed within the discharge space; and a cover that is opened and closed over the ventilating space, the developing unit comprising:

a developing member that supplies a developer to the second image-carrying member to develop the electrostatic latent image on the surface of the second image-carrying member into a visible image; and a pressing member that presses and closes the cover of the image-forming apparatus when the developing unit is moved toward the accommodating space so as to be mounted in the accommodating space.

23. The developing unit according to claim 22, wherein the pressing member is a protrusion.

* * * * *